US009085882B2

(12) United States Patent
Hanna et al.

(10) Patent No.: US 9,085,882 B2
(45) Date of Patent: Jul. 21, 2015

(54) SYSTEMS AND METHODS FOR PROVIDING A PROGRAMMABLE SHOWER INTERFACE

(75) Inventors: Kenneth S. Hanna, Adell, WI (US); Jacob P. Vanderheyden, Sheboygan, WI (US); Keith S. Ruh, Elkhart Lake, WI (US)

(73) Assignee: KOHLER CO., Kohler, WI (US)

( * ) Notice: Subject to any disclaimer, the term of this patent is extended or adjusted under 35 U.S.C. 154(b) by 1151 days.

(21) Appl. No.: 13/015,511

(22) Filed: Jan. 27, 2011

(65) Prior Publication Data

US 2011/0186137 A1 Aug. 4, 2011

Related U.S. Application Data

(60) Provisional application No. 61/300,087, filed on Feb. 1, 2010.

(51) Int. Cl.
*A47K 3/28* (2006.01)
*E03C 1/05* (2006.01)

(52) U.S. Cl.
CPC ..... *E03C 1/05* (2013.01)

(58) Field of Classification Search
CPC ..... G05B 19/048; G05B 19/408
USPC ..... 4/559, 605, 661, 596, 598, 601
See application file for complete search history.

(56) References Cited

U.S. PATENT DOCUMENTS

| | | | | |
|---|---|---|---|---|
| 4,854,499 | A * | 8/1989 | Neuman | 4/605 |
| 5,255,399 | A | 10/1993 | Park | |
| 5,414,879 | A | 5/1995 | Hiraishi et al. | |
| 2008/0262755 | A1 | 10/2008 | Dayton et al. | |

FOREIGN PATENT DOCUMENTS

| | | |
|---|---|---|
| CN | 2162904 | 4/1994 |
| CN | 201150886 | 11/2008 |
| EP | 1 640 837 A2 | 3/2006 |
| TW | 191877 | 10/1992 |
| WO | WO-2006/058650 | 6/2006 |

OTHER PUBLICATIONS

International Search Report and Written Opinion for PCT/US2011/022787, mail date Jun. 15, 2011, 10 pages.
Notification of the First Office Action for Chinese Patent Application No. 201180022257 with English translation, dated Mar. 27, 2014, 15 pages.
English machine-translation of TW 191877 (Oct. 1, 1992) titled "Shower unit with automatic sprinkler function with multiple shower spout", 60 pages.
Taiwan Office Action and English Translation for Taiwan Patent Application No. 100103995, dated May 13, 2014, 10 pages.
Taiwan Office Action and English Translation for Taiwan Patent Application No. 100104011, dated May 9, 2014, 10 pages.
Taiwain Office Action and English Translation for Taiwan Patent Application No. 100104012, dated Jun. 26, 2013, 17 pages.
Taiwan Office Action and English Translation for Taiwan Patent Application No. 100104010, dated Jun. 20, 2013, 20 pages.

* cited by examiner

*Primary Examiner* — Tuan N Nguyen
(74) *Attorney, Agent, or Firm* — Foley & Lardner LLP

(57) ABSTRACT

A shower generally includes a shower enclosure, various shower systems having output devices, and a control panel having an electronic display and configured for receiving user inputs. Shower control systems and methods are provided for receiving and processing user inputs, displaying a graphical user interface on the electronic display, and controlling outputs of the various output devices.

18 Claims, 14 Drawing Sheets

SYSTEMS AND METHODS FOR PROVIDING A PROGRAMMABLE SHOWER INTERFACE

CROSS-REFERENCE TO RELATED PATENT APPLICATIONS

The present application claims priority to and the benefit of U.S. Provisional Patent Application No. 61/300,087, filed Feb. 1, 2010, the disclosure of which is incorporated herein by reference in its entirety.

BACKGROUND

Showers have conventionally utilized mechanical user interface controls such as handles, knobs, selector switches, and the like. These mechanical user interface controls conventionally have a direct mechanical link to shower valves or other shower components. The mechanical user interface controls conventionally operate independently such that actuation of one control does not affect operation or actuation of another control.

It would be advantageous to provide an improved system for controlling various components of shower systems.

SUMMARY

An exemplary embodiment of the invention relates to a shower that includes a shower enclosure, various shower systems having output devices, and a control panel having an electronic display and configured for receiving user inputs. Shower control systems and methods are provided for receiving and processing user inputs, displaying a graphical user interface on the electronic display, and controlling outputs of the various output devices.

Some embodiments of the invention relate to a system in communication with an electronic display and for controlling shower outlets. The system includes a controller that causes the electronic display to display a graphical user interface. The graphical user interface includes a graphical representation of a shower layout and a graphical representation of the shower outlets. The controller is configured to receive and act upon an indication of a request to change a state of the shower outlets.

The graphical representation of the shower outlets may include one or more graphical user interface elements that are associated with one or more shower outlets. Each graphical user interface element may be selectable and the controller may be configured to act upon the received request by causing the change of the state of the shower outlets associated with the selected graphical user interface element. The controller may receive the indication of a request to change a state of the shower outlets by at least one of: (a) receiving data from a touch screen portion of the electronic display, and (b) receiving data from control circuitry in communication with a user input device associated with the electronic display. The controller may act upon the indication of the request to change the state of the shower outlets by providing a command, control signal, and/or data describing the request to a device that causes state changes the shower outlets.

The user-specified output adjustment may includes at least one of changing water temperature and changing water flow. Each graphical user interface element may include at least one visual characteristic indicative of a physical characteristic of its one or more associated shower outlets. The at least one visual characteristic may include at least one of: (a) shape, (b) shading, (c) pattern, (d) color, and (e) position in the graphical representation of a shower layout. The at least one physical characteristic may include at least one of shower outlet type, shower outlet flow, shower outlet grouping, and shower outlet position. The graphical representation of the shower layout may be visually representative of a specific physical shower. The graphical representation of the shower layout may include a graphical representation of at least one wall and the graphical representation of the shower outlets may be located on the at least one wall.

Other embodiments of the invention relate to a method for controlling shower outlets. The method includes causing display of a graphical user interface including a graphical representation of a shower layout and a graphical representation of the shower outlets. The method further includes receiving and acting upon an indication of a request to change a state of the shower components.

The graphical representation of the shower outlets may include one or more graphical user interface elements associated with the one or more shower outlets. The method may further include receiving a selection of one of the graphical user interface elements. The method may also include receiving an output adjustment request for the selected graphical user interface element. The method may yet further include causing an output adjustment for the one or more shower outlets associated with the selected graphical user interface element.

The output adjustment of the method may include at least one of changing temperature and changing flow. The method may further include causing a change to a visual characteristic of the selected graphical user interface element in response to the selection and the output adjustment. The method may yet further include displaying a second graphical user interface for allowing a user to configure the shower layout, and creating the graphical representation of the shower layout based on the user configuration of the shower layout.

Some other embodiments of the invention relate to a system in communication with an electronic display and for controlling shower outlets. The system includes a controller that causes the electronic display to display a graphical representation of a shower and a plurality of graphical user interface shower elements. Each of the graphical user interface shower elements are associated with one or more shower elements.

The graphical user interface shower elements may include a visual characteristic that is at least one of: shape, shading, color, pattern, and positioning. Each of the shower outlets associated with the graphical user interface shower elements may include a physical characteristic that is at least one of a type, a flow, a physical grouping, and a position. Each visual characteristic of the graphical user interface shower elements is associated with a physical characteristic of the shower outlets. The one or more graphical selection elements may include visual characteristics matching the visual characteristics of the graphical user interface shower elements. The one or more graphical selection elements may be selectable and the output of the shower outlets associated with the graphical user interface shower elements having matching visual characteristics may be adjusted via user input subsequent to the selection. The controller is configured to receive an indication of a request to change output for the shower outlets and to act upon the received indication. The common visual characteristic may be color and the common physical characteristic may be physical grouping.

Other embodiments of the invention relate to a system in communication with an electronic display and for controlling shower outlets. The system includes a controller that causes the electronic display to display a graphical user interface. The graphical user interface includes a plurality of graphical user interface elements. Each graphical user interface element is associated with a group of shower outlets and displays an indication of temperature for the group of shower outlets.

The indication of temperature may include alphanumeric text. The indication of temperature is set in response to a previously stored user setting or a user input received at a user input device. Each graphical user interface element may be selectable and the user-specified temperature for the group of shower outlets may be adjusted via user input received subsequent to the selection. The controller may be configured to receive an indication of a user-specified temperature adjustment for the group of shower outlets and to act upon the received indication.

Each graphical user interface element may be matched to a graphical representation of its associated group of shower outlets via a common visual characteristic. The common visual characteristic may be color. Acting upon the received indication may include at least one of communicating a request to a downstream device or controller, and providing a control signal to a valve or valve controller associated with the group of shower outlets.

Other embodiments of the invention relate to a method for controlling shower output devices. The method includes causing display of a graphical user interface including a plurality of graphical user interface elements, each of the graphical user interface elements associated with a group of shower outlets. The method also include causing each graphical user interface element to display an indication of temperature of its associated group of shower outlets.

The indication of time may be or include alphanumeric text. The indication of time may also or alternatively include graphics. The method may further include receiving a selection of one of the graphical user interface elements. The method may also include receiving a temperature adjustment request for the selected graphical user interface element. The method may yet further include causing the temperature of the group of shower outlets to be adjusted in response to the received temperature adjustment.

The method may include causing change of a visual characteristic of the selected graphical user interface element. The method may also include causing the indication of temperature to change in response to the received temperature adjustment request. The method may include causing the temperature of the group of shower outlets to be adjusted independent of another group of shower outlets. The method may yet further include displaying a graphical representation of shower outlets associated with the graphical user interface elements, the graphical representation having a common visual characteristic with the graphical user interface elements. The common visual characteristic may be or include color.

Other embodiments of the invention relate to computer-readable media with computer-executable instructions embodied thereon that when executed by a computer system (e.g., control panel, controller, shower controller, etc.) perform a method for controlling shower output devices. The instructions include instructions for causing display of a graphical user interface including a plurality of graphical user interface elements, each of the graphical user interface elements associated with a group of shower outlets. The instructions further include instructions for causing each graphical user interface element to display an indication of temperature of its associated group of shower outlets.

The instructions further include instructions for receiving a selection of one of the graphical user interface elements. The instructions also include instructions for receiving a temperature adjustment request for the selected graphical user interface element. The instructions also include instructions for causing the temperature of the group of shower outlets to be adjusted in response to the received temperature adjustment.

Some embodiments of the invention relate to a system in communication with an electronic display and for controlling shower outlets. The system includes a controller that causes the electronic display to display a graphical representation of a temperature profile for a shower, the temperature profile including at least two temperature points that are adjustable in temperature and time via user interface controls. The controller causes the temperature profile to be stored in memory for use in controlling the shower components.

Controlling the shower components may include adjusting temperature of the shower outlets according to the stored temperature profile. One of the temperature points may be assigned a start temperature and start time and one other of the temperature points may be assigned an end temperature and end time. The temperature of the shower outlets may be adjusted between the start time and end time, starting at the start temperature and ending at the end temperature.

The temperature profile may include at least a third temperature point that is adjustable in temperature and time via the user interface controls. The third temperature point may be adjustable to an intermediate time between the start time and the end time. The controller may cause the temperature of the shower outlets to be adjusted to the temperature of the third point at the intermediate time. The controller may allow user input received via the user interface controls to specify a gradual temperature adjustment. The controller may allow user input received via the user interface controls to specify an abrupt temperature adjustment.

The controller may be configured to receive and act upon an indication of a user-specified temperature adjustment for the shower outlets. Acting upon the indication of the user-specified adjustment for the shower outlets may include adjusting the stored temperature profile to reflect the adjustment. The user-specified output adjustment may include adding or removing a temperature point.

Other embodiments of the invention relate to a method for controlling shower outlets. The method includes causing display of a graphical user interface including a graphical representation of a temperature profile. The method also includes using user inputs received at a user input device to adjust at least two temperature points of the temperature profile in time and temperature. The method also includes causing the temperature of the shower outlets to be adjusted according to the temperature profile.

The method may further include updating data for the temperature profile stored in non-volatile memory. The method may include adjusting the temperature of the shower outlets to a temperature of a third temperature point. The method may include receiving an indication of a request to add or remove a temperature point. The method may further include, according to the request, causing the graphical representation of the temperature profile to include one more or one fewer temperature points. The method may also include receiving an indication of a request to select a transition of the temperature profile to a ramp transition or a step transition, and causing the graphical user interface to display an indication of the transition selected. The method may yet further include receiving indications of requests to adjust the temperature and time of one of the temperature points. In response to the request and according to the request, the method may include adjusting the graphical representation of the temperature profile and adjusting data for the temperature profile stored in a non-volatile memory.

Other embodiments of the invention include computer-readable media with computer-executable instructions embodied thereon that when executed by a computer system perform a method for controlling shower output devices. The instructions include instructions for causing display of a graphical user interface including a graphical representation of a temperature profile, the temperature profile having at least two temperature points that are adjustable in time and temperature. The instructions further include instructions for causing the temperature of the shower outlets to be adjusted according to the temperature profile.

The instructions may further include instructions for causing data for the temperature profile stored in non-volatile memory to be updated in response to a request for adjustment of the time and temperature of the at least two temperature points. The instructions may also include instructions for adding temperature points to the temperature profile in response to user input received at a user input device, the temperature points defined by time and temperature.

Other embodiments of the invention relate to a system in communication with an electronic display and for controlling shower output devices. The system includes a controller that causes the electronic display to display a graphical user interface that comprises a menu of one or more previously stored shower experiences. The controller is configured to display, in response to selection from the menu of one of the stored shower experiences, a plurality of graphical user interface elements that each indicate a type of shower output device programming associated with the selected shower experience.

The controller may be configured to respond to a request to execute the selected shower experience by causing the shower output devices to change outputs according to the shower output device programming associated with the selected shower experience. The plurality of graphical user interface elements may include an element representing music programming for controlling one or more sound output device. The plurality of graphical user interface elements may include an element representing lighting programming for controlling one or more light output devices. The plurality of graphical user interface elements may also or alternatively include an element representing steam programming for controlling one or more steam output devices. The plurality of graphical user interface elements may include an element representing temperature zone programming for controlling one or more shower outlets. The plurality of graphical user interface elements may include an element representing temperature therapy programming for controlling one or more shower outlets. The plurality of graphical user interface elements may include an element representing massage programming for controlling one or more shower outlets.

The controller may be configured to present graphical user interface tools or screens for allowing the user adjustment of the shower output device programming associated with the selected shower experience. The controller may be configured to present graphical user interface tools or screens for allowing the addition or deletion of types of shower output device programming associated with the selected shower experience. The graphical user interface may include a graphical representation of a shower layout.

Other embodiments of the invention relate to a method for controlling shower output devices. The method includes causing display of a graphical user interface including a menu of previously stored shower experiences. The method further includes receiving an indication of a user selection from the menu of previously stored shower experiences. The method also includes, in response to the selection, causing display of a plurality of graphical user interface elements that each indicate a type of shower output device programming associated with the selected shower experience.

The method may include receiving an indication to recall the selected shower experience and causing adjustment of output of the shower output devices according to the programming associated with the selected shower experience. The method may further include causing display of a graphical user interface that includes a graphical representation of a shower layout that comprises shower outlet elements that represent physical shower outlets. The method may also include causing a change of a visual characteristic of each shower outlet element that represents physical shower outlets associated with the selected shower experience.

Other embodiments of the invention relate to computer-readable media with computer-executable instructions embodied thereon that when executed by a computer system perform a method for controlling shower output devices. The instructions include instructions for causing display of a graphical user interface including a menu of previously stored shower experiences. The instructions also include instructions for receiving an indication of a sure selection from the menu of previously stored shower experiences. The instructions yet further include instructions for causing, in response to the selection, display of a plurality of graphical user interface elements that each indicate a type of shower output device programming associated with the selected shower experience. The instructions also include instructions for receiving an indication to recall the selected experience. The instructions further include instructions for causing, in response to the indication to recall, causing adjustment of output of the shower output devices according to the programming associated with the selected shower experience.

Alternative embodiments relate to other features and combinations of features described herein. Embodiments relating to a first feature such as the adjustment and use of temperature profiles may be combined with any other embodiment described herein and relating to a second feature (e.g., shower experiences). Therefore, even if a particular combination is not expressly mentioned herein, the present disclosure should be considered to include all possible combinations of features and embodiments.

BRIEF DESCRIPTION OF THE FIGURES

The application will become more fully understood from the following detailed description, taken in conjunction with the accompanying figures, wherein like reference numerals refer to like elements, in which.

DETAILED DESCRIPTION

Referring generally to the Figures, a shower includes a shower enclosure, various shower subsystems having output devices, and a control panel having an electronic display. The electronic display is configured to display a graphical user interface for allowing user control of the various shower subsystems or shower output devices. A controller, which may be integrated with the control panel, physically separate from the housing of the control panel, or partially integrated and partially separate from the control panel, is in communication with the electronic display and causes the varying graphical user interfaces to be displayed on the electronic display. The control panel receives user inputs via buttons (i.e., hard keys), a touch screen portion of the electronic display, and/or via other user input devices in communication with the control panel and/or the controller. The control panel (e.g., via the controller) controls various components of the shower in response to the user inputs (e.g., signals or data representing the user inputs received at the one or more user input devices). Accordingly, a shower control system is provided for receiving and processing user inputs, displaying a graphical user interface on the electronic display, and controlling outputs of the various output devices (e.g., shower outlets, flow control valves, temperature control valves, solenoids associated with the valves, lighting devices for the shower, audio output systems for the shower, etc.). The shower control system advantageously includes software that causes the generation and display of intuitive graphical user interfaces for providing an intuitive and powerful control experience to the user. Settings and combinations of settings may be saved in the shower control system (e.g., a controller of the system) for later playback (e.g., execution) by a controller of the shower control system. Such playback or execution causes actuation, adjustment, or another state change of one or a plurality of the shower output devices.

Figure 1:
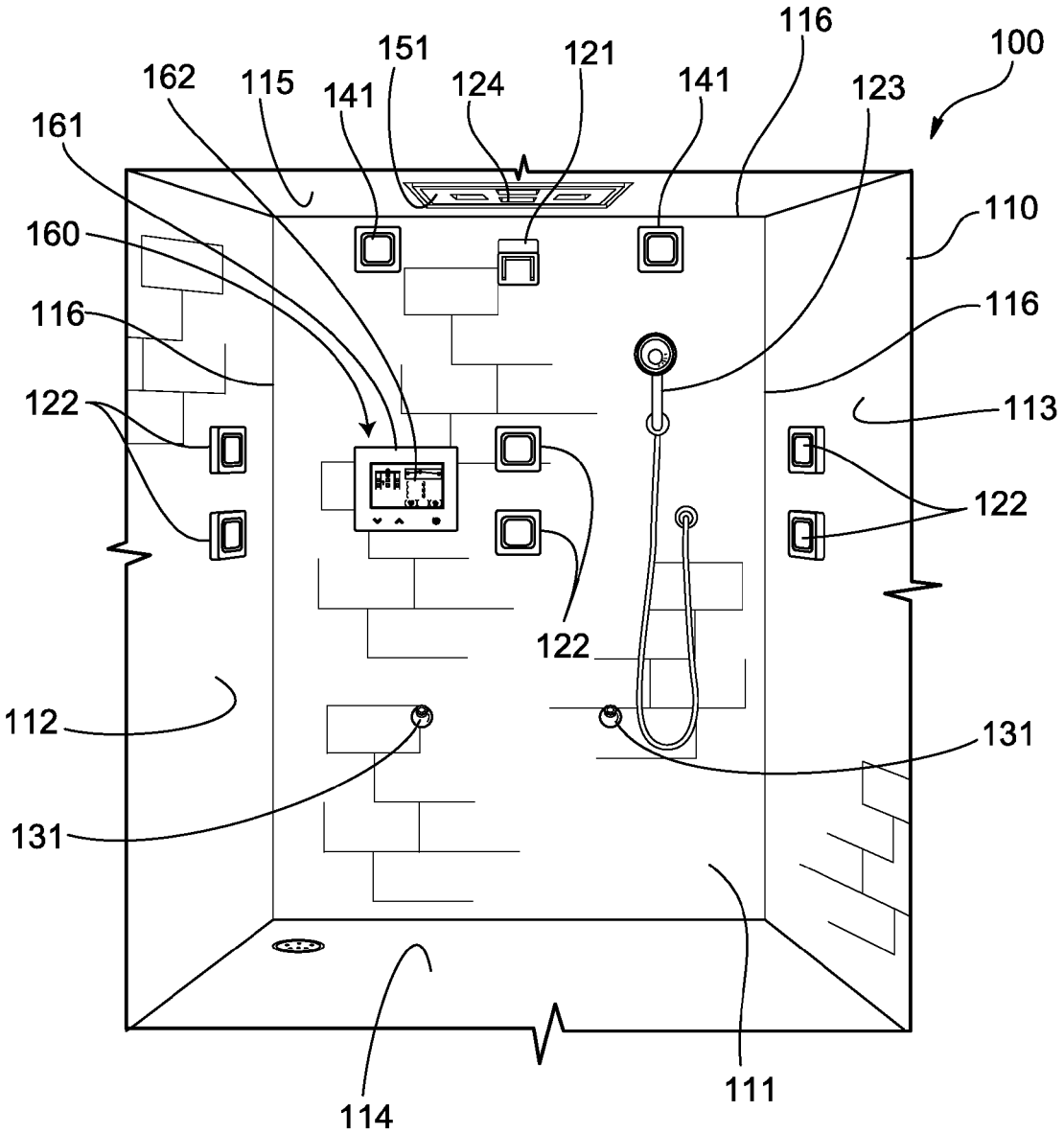
FIG. 1 is an illustration of a shower according to an exemplary embodiment.

Referring now to FIG. 1, a shower control system includes and controls a shower 100. The embodiment of FIG. 1 illustrates shower 100 as including a shower enclosure 110. Shower enclosure 110 is defined by a front wall 111, left wall 112, right wall 113, floor 114, and ceiling 115. An access door may permit entry by the user into the shower enclosure 110. The control systems and methods of the present disclosure may be used in combination with any shape or size of shower enclosure. For example, alternative shower enclosures may contain fewer or additional walls, be of varying sizes, contain other water outlets or lighting arrangements, or be otherwise configured.

According to an exemplary embodiment, the shower 100 includes various output devices, which are disposed within the shower enclosure 110. For example, according to an exemplary embodiment, a water subsystem includes shower outlets (i.e., output devices), such as showerhead 121, body sprays 122, a handshower 123, and a rainhead 124. According to other exemplary embodiments, the water subsystem or set of output devices may include any number or combinations of output devices. The water subsystem may include one or more analog or digital valves. Valves of the system may be configured to allow for an electronically controlled mixing of hot and cold water. Such mixing can allow control systems and methods described herein to achieve or approach certain target temperatures. Valves of the system may also be configured to allow for electronically controlled or selected shower outlet water flow. The electronically controlled valves (e.g., solenoids for actuating the hydraulic valves) are controlled via control signals from one or more controllers of the shower control systems described throughout this disclosure.

According to an exemplary embodiment, the shower 100 includes a steam subsystem. The steam subsystem includes steam outlets 131 that receive steam from a steam generator in fluid communication with the steam outlets 131. The steam generator is disposed between, and coupled via conduit (e.g., piping or tubing), to the steam outlets 131 and a water supply. The steam generator heats the water, turning it into steam that is then communicated into the shower enclosure 110 through the steam outlets 131. The steam generator are controlled via control signals from one or more controllers of the shower control systems described throughout this disclosure.

According to an exemplary embodiment, the shower 100 includes a music subsystem. The music subsystem includes speakers 141, an amplifier, and a media player. The amplifier, media player, and other components may be located proximate to or remote from the shower enclosure 110. The music subsystem is configured to communicate sound into the shower enclosure 110. The music subsystem (e.g., a media player thereof) may be controlled via control signals from one or more controllers of the shower control systems described throughout this disclosure.

According to an exemplary embodiment, the shower 100 includes a lighting subsystem. The lighting subsystem includes one or more lights 151, such as conventional light bulbs (e.g., incandescent, LED, fluorescent) or a plurality of colored lights configured for use as a lighted rain panel used for chromatherapy. The lighting subsystem is configured to selectively supply light into the shower enclosure 110. The lighting subsystem (e.g., particular switches for the lights, dimmers for the lights, etc.) may be controlled via control signals from one or more controllers of the shower control systems described throughout this disclosure.

According to an exemplary embodiment, the control panel 160 is configured to receive user inputs for controlling the shower subsystems and for communicating settings and status information of the shower subsystems to the user. The control panel 160 generally includes a housing 161 and an electronic display 162. The housing 161 includes various attachment points (e.g., brackets, fasteners, portions for receiving screw heads, etc.) for mounting the control panel 160 within the shower enclosure 110. The housing 161 also provides a waterproof casing to protect the electronic display 162 and associated internal electronic components from moisture. A group of hard keys (i.e., physical buttons) may also be provided on the housing 161 for receiving user inputs. According to an exemplary embodiment, the electronic display 162 provides or includes a touch screen interface. The electronic display 162 can be caused to display graphical user interfaces and to receive user inputs via the touch screen interface.

Figure 2:
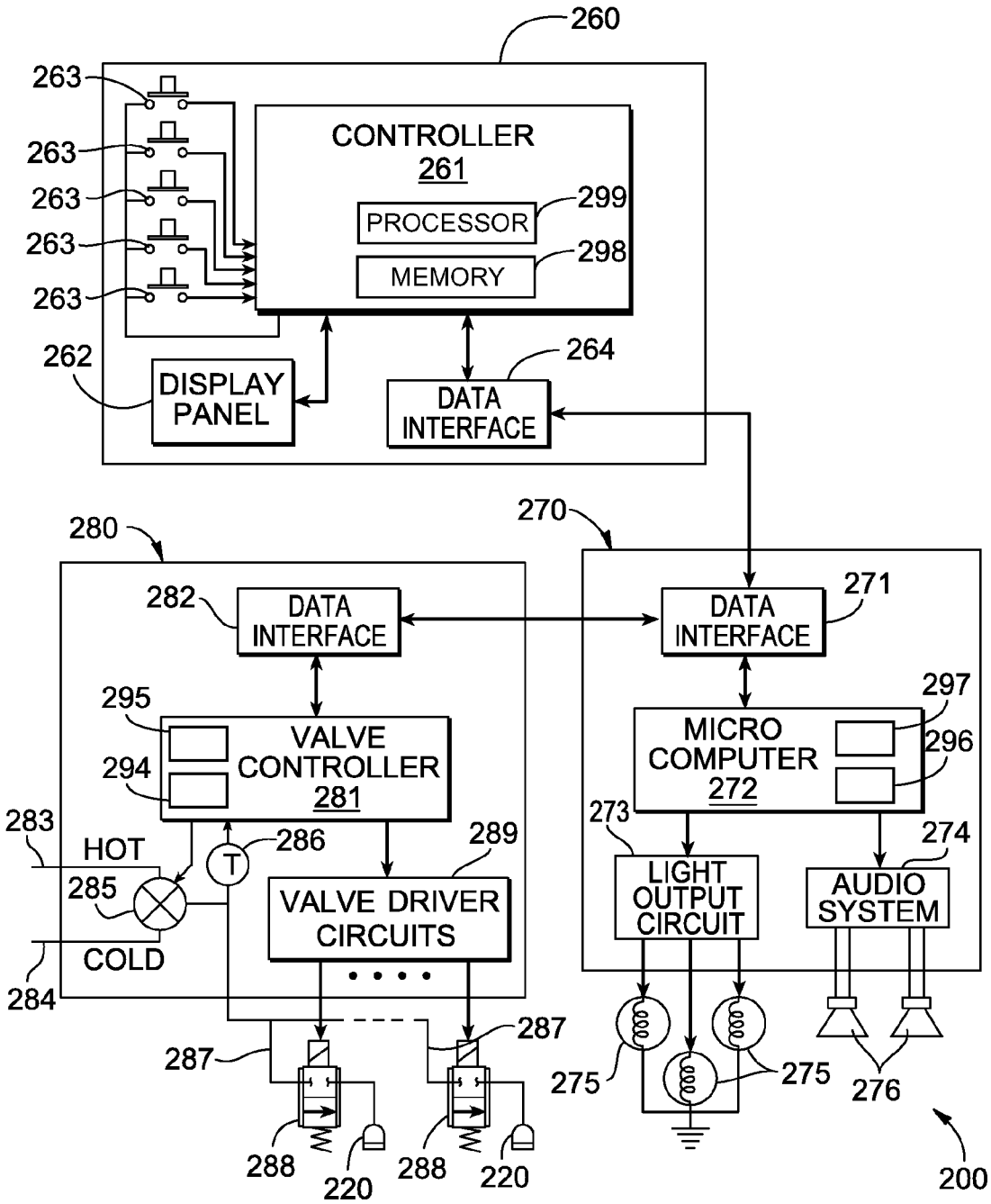
FIG. 2 is a block diagram of system for controlling shower output devices according to an exemplary embodiment.

Referring now to FIG. 2, according to an exemplary embodiment, the shower control system 200 generally communicates with and controls display panel 262. Display panel 262 may correspond with electronic display 162 and the shower subsystems or output devices described with reference to FIG. 1. The shower control system 200 processes user inputs received at user input devices (e.g., a touch screen, buttons, switches, or other user input devices of control panel 160 shown in FIG. 1, etc.). The shower control system 200 communicates with the shower subsystems or devices, such as those shown in FIG. 1, for controlling output of the various output devices. For example, the system 200 may receive an indication to adjust the temperature of one of the shower outlets (e.g., the indication based on user input received at a touch panel interface), and acts upon the indication by causing water with increased temperature to flow through the shower outlet (e.g., by sending an appropriate control signal to the appropriate mixing valve subsystem) and causing the electronic display (i.e., display panel 262) to indicate the requested and completed adjustment in temperature.

Referring to FIG. 2, a block diagram for the shower control system 200 is shown depicting the control panel 260, shower subsystems, and controllers 261, 270, according to an exemplary embodiment. The shower control system 200 generally refers to the electronics involved in processing and communicating signals for controlling the shower subsystems according to user inputs, but may also refer to any of the controlled shower subsystems or shower output devices themselves. The shower control system 200 receives indications to change conditions of the various output devices, such as from the user input devices, and acts upon the indications by sending signals to the control panel, shower subsystems or devices/controllers thereof.

According to an exemplary embodiment, the system controller 270 is configured to receive signals from the control panel 260, digital valves 280, or other shower subsystems, process the signals received, and act upon signals received. System controller 270 may act upon signals received by sending yet other control signals to devices such as light output circuitry 273 and audio system 274. System controller 270 may also act upon signals received by sending yet other control signals to digital valves 280 or other shower subsystem components.

The system controller 270 generally includes a data interface 271, microcomputer 272, and subsystem circuits 273, 274. The data interface 271 is configured to be in communication with the data interfaces of the control panel 260 and digital valves 280, such as through hard-wired cable connections or other physical connection. The data interface 271 enables the system controller 270 to send and receive signals to and from the control panel 260 and digital valves 280. The microcomputer 272 includes a processor 297 and local memory 296. According to an exemplary embodiment, microcomputer 272 and/or processor 297 can be implemented as a general purpose processor, an application specific integrated circuit (ASIC), one or more programmable logic controllers (PLCs), one or more field programmable gate arrays (FPGAs), a group of processing components connected to one or more circuit boards, one or more digital signal processors, other suitable electronics components, or a combination thereof. The microprocessor processes received signals according to the software and data in the local memory, and sends signals resulting from the processing to the control panel 260, digital valves 280, and shower subsystems. For example, the microcomputer 272 receives signals with user input information from the control panel 260 and signals with shower system condition information from the digital valves and shower systems, and sends signals with display information to the control panel and command information to the digital valves 280, light output circuit 273, audio system 274, or other shower subsystems.

Memory 296 (e.g., memory unit, memory device, storage device, etc.) is one or more devices for storing data and/or computer code for completing and/or facilitating the various processes described in the present disclosure. Memory 296 may be or include volatile memory or non-volatile memory. Memory 296 may include database components, object code components, script components, or any other type of information structure for supporting the various activities described in the present disclosure. According to an exemplary embodiment, memory 296 is communicably connected to processor 297 via processing circuit 272 and includes computer code for executing (e.g., by processor 297) one or more processes described herein. Memory 296 may also include various resource data for the graphical user interfaces described herein. For example, memory 296 may include graphics, web pages, HTML files, XML files, script code, shower configuration files, or other resources for use in control panel 260's generation of graphical user interfaces for display.

According to an exemplary embodiment, the control panel 260 is configured to receive user input and to display information to the user. The control panel 260 includes a controller 261, electronic display 262, touch elements 263, and data interface 264. The controller 261 includes ports, a microprocessor 299, and local memory 298. The ports are configured to transmit signals between the processor 299 and the display 262, touch elements 263, data interface 264, or other components of or connected to controller 261 or control panel 260. The processor 299 processes data signals received according to software and data stored on the local memory 298, and acts upon signals received by sending signals to the display 262 and system controller 270. According to an exemplary embodiment, controller 261 and/or processor 299 can be implemented as a general purpose processor, an application specific integrated circuit (ASIC), one or more programmable logic controllers (PLCs), one or more field programmable gate arrays (FPGAs), a group of processing components connected to one or more circuit boards, one or more digital signal processors, other suitable electronics components, or a combination thereof.

Memory 298 (e.g., memory unit, memory device, storage device, etc.) is one or more devices for storing data and/or computer code for completing and/or facilitating the various processes described in the present disclosure. Memory 298 may be or include volatile memory or non-volatile memory. Memory 298 may include database components, object code components, script components, or any other type of information structure for supporting the various activities described in the present disclosure. According to an exemplary embodiment, memory 298 is communicably connected to processor 299 via a printed circuit board of controller 261 and includes computer code for executing (e.g., by processor 299) one or more processes described herein. Memory 298 may also include various resource data for the graphical user interfaces described herein. For example, memory 298 may include graphics, web pages, HTML files, XML files, script code, shower configuration files, or other resources for use in control panel 260's generation of graphical user interfaces for display.

According to an exemplary embodiment, the display 262 is configured to display a graphical user interface and to receive user input (e.g., via touch elements 263). More particularly, the display 262 is a touch screen display, which graphically displays information and soft keys (i.e., graphics displayed in a location of the display configured to receive user input). The soft keys may, for example, depict a virtual button, slider, dial, switch, keypad, or other graphic. The display 262 is also configured to receive user inputs, such as when the user touches or presses one of the soft keys, or performs a gesture on the screen, such as a swiping motion.

According to an exemplary embodiment, the display 262 is a liquid crystal display ("LCD") measuring approximately 7" diagonally and employs resistive touch sensitive technology. According to other exemplary embodiments, the touch screen interface may use other display technologies particularly suited or adapted for use in a wet environment, which may be smaller or larger (e.g., 5" and smaller, or 9" and larger), may use other touch sensitive technologies as may be applied in wet environments, or may use touch sensitive technology in combination with hard keys (i.e., physical buttons) located elsewhere on the control panel.

According to an exemplary embodiment, the control panel 260 can include buttons, switches, or other user input devices for receiving user inputs. Such buttons, switches or other user interface devices may be momentary contact switches disposed on the control panel housing and are configured such that, when pressed by the user, a circuit to the display controller 261 closes to send a signal to the display controller 261. The data interface 264, as referred to above, is connected by cable, wire, or other physical connection to the data interface 271 of the system controller 270 to enable communication between the control panel 260 and the system controller 270.

According to an exemplary embodiment, one or more digital valves 280 are configured to selectively mix hot and cold water and selectively control water output to the shower outlets. Each digital valve 280 is arranged between, and coupled via conduit (e.g., piping or tubing) to, the shower outlets (e.g., FIG. 1, 121-124) and water supplies. Each digital valve 280 includes a valve controller 281, data interface 282, hot water inlet 283, cold water inlet 284, inlet mixing valve 285, temperature sensor 286, water outlets 287, outlet valves 288, and valve driver circuits 289. The mixing valve 285 and outlet valves 288 may be electrically operated. In an exemplary embodiment, the mixing valve 285 is a digital thermostatic mixing valve and one or more of the outlet valves 288 are electrically-actuated solenoid valves.

According to an exemplary embodiment, the hot and cold water inlets 283, 284 are configured to be coupled via conduit (e.g., piping or tubing) to hot and cold water supplies, respectively. The mixing valve 285 may be actuated by one of the valve driver circuits 289 and is configured to allow relative amounts of hot and cold water into the digital valve 280 to achieve a specified water temperature.

According to an exemplary embodiment, each water outlet 287 is coupled via conduit (e.g., piping or tubing) to one or more shower outlets 220. Each outlet valve 288 may be actuated by one of the valve driver circuits 289 and is configured to open and close to allow water to pass through shower outlets 220.

According to an exemplary embodiment, the valve controller 281 controls operation of the mixing valve 285 and outlet valves 288. The valve controller 281 receives signals from the system controller 270 through the data interface 282 and the temperature sensor 286, processes signals received, and acts upon the received signals by operating the mixing valve 285 and outlet valves 288 through the valve driver circuits 289. For example, the valve controller 281 receives signals from the system controller 270 regarding a specified temperature and from the temperature sensor 286 as to the actual water temperature, processes signals received, and acts upon them by sending signals for adjusting the mixing valve 285 to achieve the specified temperature. The valve controller 281 may also receive signals from the system controller 270 regarding which outlet valves 288 should be opened or closed, processes signals received, and acts upon them by sending signals to the valve driver circuits 289 to open or close the outlet valves 288. Valve controller 281 includes processor 295 and memory 294. Processor 295 and memory 294 may be general purpose processing and memory components, include one or more programmable logic controllers, one or more programmable gate arrays, a group of processing components, other suitable electronics components, volatile memory, non-volatile memory, or a combination thereof.

According to an exemplary embodiment, the digital valve 280 includes sensors for measuring conditions other than temperature, such as valve position and water pressure. The sensors, similar to the temperature sensor 286, send signals with condition information to the valve controller, which then processes the signals, and acts upon them, by sending signals to the valve driver circuits 289 and/or the system controller 270.

According to an exemplary embodiment, the digital valve assembly does not include outlet valves. Instead, outlet valves may be disposed between the digital valve assembly and the showerheads, may be attached directly to the showerheads, or may be integral with the showerheads. According to another exemplary embodiment, the digital valve assembly is attached directly to or is integral with the showerhead, eliminating the need for the outlet valve.

According to an exemplary embodiment, other shower subsystems (e.g., steam, music, and light) are also controlled by the user through the control panel. Each system may include a controller and data interface that is configured for receiving signals, processing those signals, and acting upon signals received by sending signals for controlling their various components and communicating system information to the user through the control panel. The steam, music, and lighting systems may also include sensors for detecting conditions of the respective systems, such as temperature, humidity, volume, and luminosity.

According to other exemplary embodiments, the control electronics (e.g., controller, microprocessor, data interface) for one or more of the control panel, system controller, digital valve, and other systems may be integral with each other. For example, according to an exemplary embodiment, the system controller 270 incorporates the control electronics for the lighting and audio systems, thus obviating the need for separate system control electronics and providing only subsystem circuits 273, 274 to the lights 275 and speakers 276.

According to an exemplary embodiment, the control panel and shower control system are configured for displaying a graphical user interface on the electronic display of the control panel. The graphical user interface includes graphics that enable the user to quickly and intuitively determine the settings and status for the shower systems and to change settings through hard keys (i.e., physical buttons), soft keys (i.e., virtual buttons on a touch screen), or other user input devices. Program modules are provided for controlling one or more of the shower systems.

In subsequent Figures, processes and corresponding graphical user interfaces are shown. Computer code modules, instruction sets, or other resources for causing, executing, or facilitating these processes and the related graphical user interfaces may be stored in memory 298, memory 296, memory 294 or across memory of the controllers (e.g., control panel 260, controller 270, controller 281). It should be appreciated that "a controller" recited in the claims can be or include any of control panel 260 and its integral controller, controller 270, and controller 281. In other words, the computer code instructions for causing the display of the graphical user interfaces described herein can vary from what is shown in FIG. 2 (according to varying system architectures) and yet fall within the scope of the appended claims.

Now referring to FIG. 3 and FIGS. 4, 4A, and 4B, according to an exemplary embodiment, a method and system are provided for a graphical user interface displaying a "virtual shower." According to an exemplary embodiment, the graphical user interface displays graphical elements for quick and intuitive information recognition and input by the user. For example, the information and soft keys displayed are configured to be easily distinguished by users with compromised vision, such as from steam in the shower enclosure, moisture on the display, or deteriorated vision. Each soft key displays a graphical user interface element that includes a combination of distinguishing visual features that provide information related to the physical feature associated with each element. For example, the graphical user interface elements may include figures that are indicative of the function of a corresponding physical feature, may be grouped in particular areas of the touch screen interface, may have a particular color, shading, size, background, luminosity, or any combination thereof.

Figure 4:
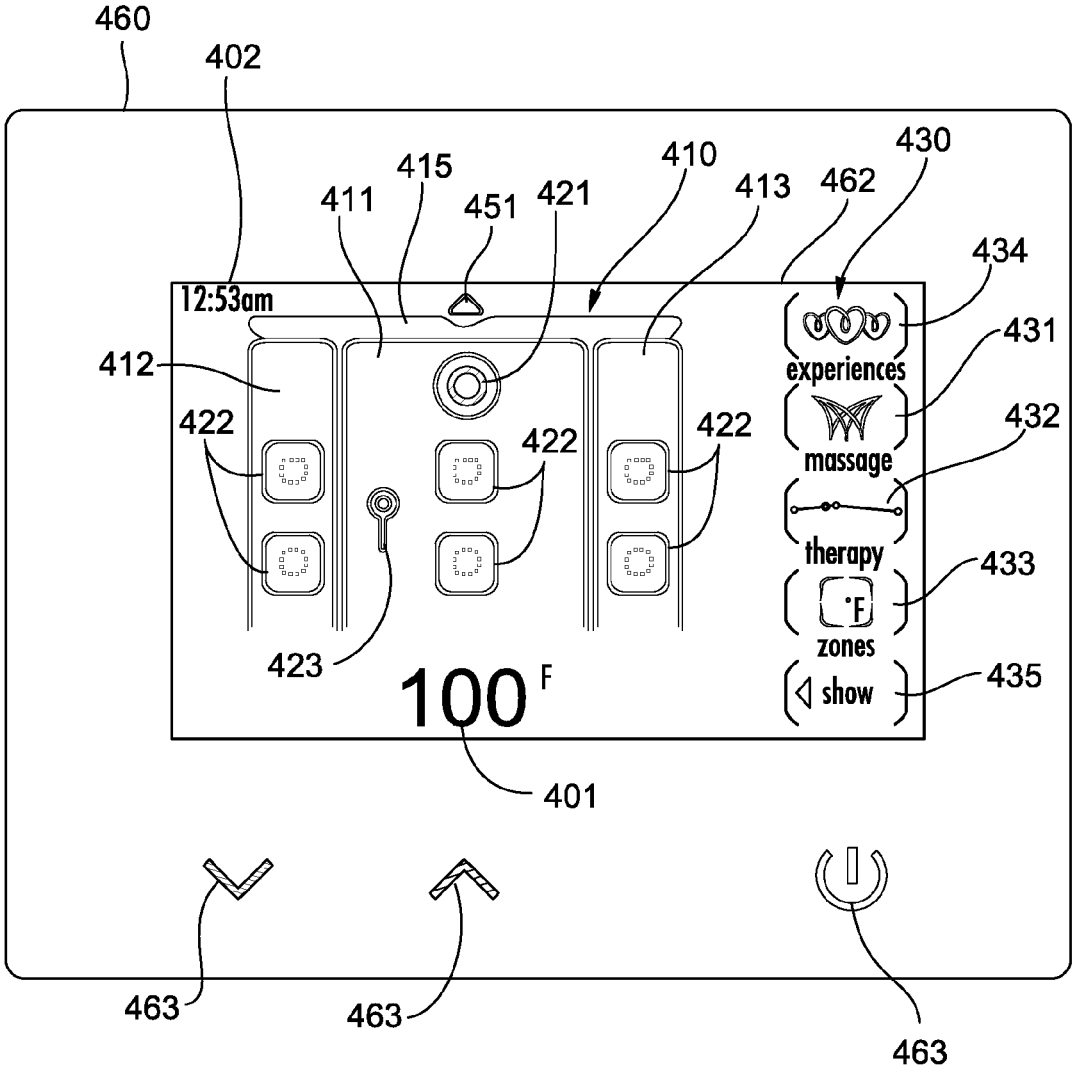
FIG. 4 is an illustration of a control panel and a graphical user interface displaying a home screen that includes a graphical representation of a shower layout according to an exemplary embodiment.

Now referring to FIG. 4, according to an exemplary embodiment, the graphical user interface displays a home screen 462 on the display of the control panel 460. The home screen 462 displays a first group of elements, each element corresponding to one physical showerhead that may be controlled through the control panel 460. A second group of elements 430 includes elements that correspond to program modules (e.g., an element 434 for experiences, an element 431 for massage, an element 432 for temperature therapy, and an element 433 for temperature zones) for controlling the physical shower outlets and other shower systems (e.g., steam, music, lighting). The home screen 462 also displays the current water temperature 401, current time 402, and a "show" element 435. When the show element 435 is touched, the home screen 462 displays additional group of elements 430 corresponding to other program modules or systems that may be selected by the user to display control screens for the respective modules or systems. The group of elements 430 may also be customized by the user, for example, to display those elements 430 associated with systems or modules most often used. The control panel may also include hard keys 463 configured to receive user input when the user presses one of the hard keys 463.

According to an exemplary embodiment, one group of elements (e.g., 421, 422, 423) representing shower outlets is displayed on a leftward-oriented portion of the screen, whereas another group of elements 430 (e.g., 431, 432, 433, 434) representing systems or modules is displayed on a rightward-oriented portion of the screen. According to other exemplary embodiments, the various elements may be arranged in other configurations. By disposing different functional groups of graphical user display elements (i.e., those representing shower outlets, and those representing systems or modules) in different areas of the touch screen interface, the user may quickly and intuitively determine which groups of elements are related to which shower features.

According to an exemplary embodiment, each element 421, 422, 423 corresponds to one or more physical shower outlets. Each element representing a physical shower outlet depicts a figure that is visually indicative of the type of showerhead to which the element corresponds. For example, element 421 represents a showerhead, having a generally circular shape (i.e., common of many physical showerheads) and a ring of dots within the circle (i.e., representative of nozzles). Element 422 represents a body spray, having a generally square shape (i.e., that of body spray tiles) and a ring of dots within the square (i.e., representative of nozzles). Element 423 represents a handshower and is generally spoon-shaped (i.e., like a handshower). By providing soft key with graphical user interface elements of varying shapes that are visually indicative of specific types of shower outlets, the user may quickly and intuitively distinguish which elements are associated with each type of physical shower outlet.

According to an exemplary embodiment, each element representing physical shower outlets includes visual characteristics that are indicative of an output condition of the shower outlet associated with the element. According to an exemplary embodiment, each element is shaded according to whether its corresponding physical shower outlets are on or off. For example, element 421 may be shaded (i.e., have the interior portion of the circle partially filled to signify that water is flowing through the showerhead) to indicate that the traditional shower outlet corresponding to element 421 is on. For example, elements 421, 422 are depicted without shading to indicate that the showerhead and body sprays that correspond to elements 421, 422, respectively, are turned off. By providing shading for each graphical user interface element representing a shower outlet, the user may quickly and intuitively determine which physical shower outlets are on and which are off.

According to another exemplary embodiment, each element representing a shower outlet may have a background to indicate water flow. For example, the background may be a solid pattern with varying shade corresponding to water flow rates, such as no shading to indicate no water flow, light shading to indicate low water flow, and dark shading to indicate high flow. Instead, or additionally, the background may include a different pattern to indicate water flow pattern, such as a solid background to indicate constant flow or a zig-zag pattern to indicate the pulsating flow of a massage program module. By providing different backgrounds for each of the graphical user interface elements representing physical shower outlets, the user may quickly and intuitively determine the flow pattern of each physical shower outlet.

According to an exemplary embodiment, elements representing a physical shower outlet have particular colors that indicate temperature groupings of the corresponding physical shower outlets. For example, element 421 may be green and element 423 may be red, which indicates that the water temperature for the corresponding traditional showerhead and handshower, respectively, may be changed independently of each other. By providing coloring for each graphical user interface element representing a physical shower outlet, the user may quickly and intuitively determine which physical shower outlets may have their temperature changed as a group.

According to an exemplary embodiment, each graphical user interface element representing a shower outlet is of sufficient size (e.g., approximately 0.5 inches×0.5 inches) to be easily seen and recognized by the user. According to other exemplary embodiments, the shower outlet elements may be small or larger than 0.5 inches×0.5 inches. According to an exemplary embodiment, the size or resolution of the elements representing shower outlets may be adjusted by the user according to user preferences or vision quality.

According to an exemplary embodiment, the graphical user interface elements representing systems or programs depict figures that are indicative of the system or module to which they correspond. For example, element 431 represents the massage program module and depicts crossing streams of water (i.e., indicative of pulsating water). Element 432 represents the temperature therapy module and depicts a graph (i.e., indicative of a temperature profile). Element 433 represents the temperature zone module and depicts a Fahrenheit symbol (° F.) in a box (i.e., indicative of a digital thermometer). Element 434 represents the experiences module and depicts a series of hearts (i.e., indicative of users' favorite experiences). The elements representing system or modules may, similar to those representing shower outlets, use shape, color, size, shading, and other features for the user to quickly and intuitively distinguish between graphical user interface elements.

The visual characteristics of the graphical user interface elements described above and below are not meant to be limiting. In different embodiments, the graphical user interface elements representing different components, subsystems, program modules, or other features may include any combination of the characteristics described above or below in any combination with other visual characteristics capable of being displayed on the electronic display.

Figure 4A:
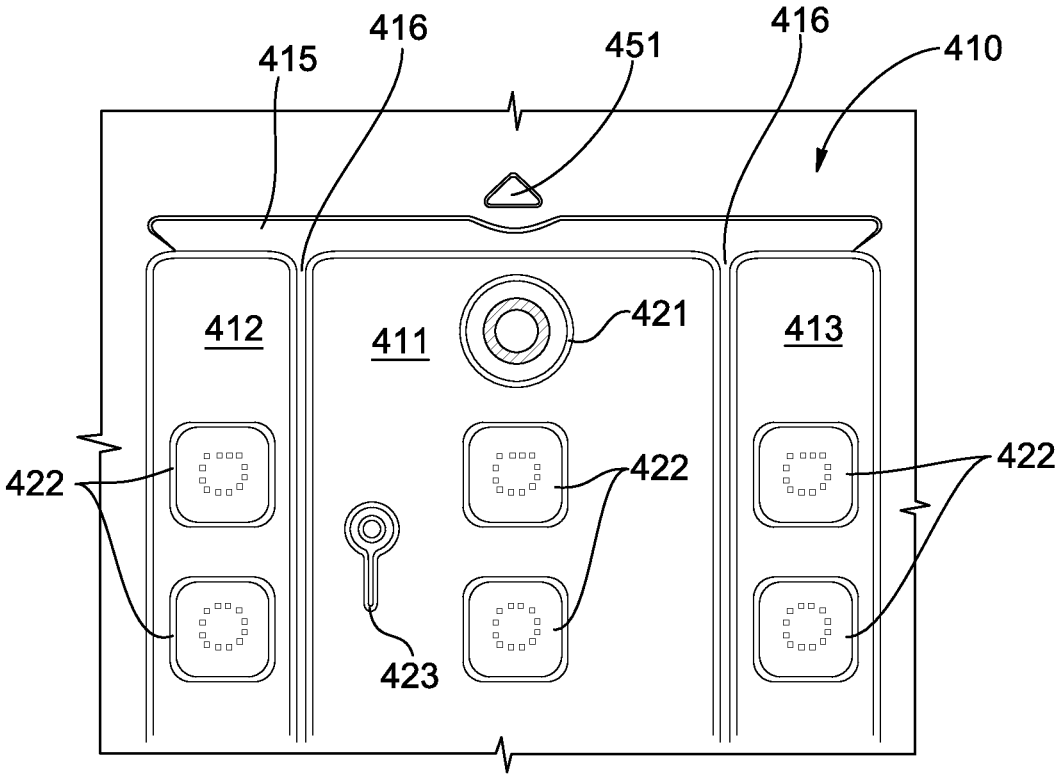
FIG. 4A is an enlarged illustration of a portion of graphical representation of a shower layout shown in FIG. 4.

Now referring to FIG. 1, FIG. 4, and FIG. 4A, according to an exemplary embodiment, the graphical user interface includes a virtual shower (i.e., a graphical representation of a shower layout) 410. The virtual shower 410 includes a group of elements that are associated with a group of physical shower outlets in the shower enclosure. More specifically, soft keys include graphical user interface elements 421, 422, 423, each displaying an image indicative of their associated physical shower outlets 121, 122, 123 in the shower enclosure 110. The elements 421, 422, 423 are also visually oriented with respect to each other in the graphical user interface in a manner that is representative of the actual arrangement of corresponding shower outlets in the physical shower enclosure 110 (e.g., forming what is essentially a "virtual" representation of the actual shower configuration). By providing graphical user interface elements having images that are visually indicative of corresponding physical shower features, and by orienting the elements in a manner visually representative of the physical orientation of corresponding physical shower features, the user may quickly and intuitively identify which elements of the virtual shower 410 correspond to each physical shower outlet disposed in the shower enclosure 110.

According to an exemplary embodiment, for example, a virtual shower 410 corresponds to a physical shower enclosure 110 and is displayed on the graphical user interface. The virtual shower 410 includes a virtual front wall 411 that corresponds to physical front wall 111, a virtual left wall 412 that corresponds to physical left wall 112, and a virtual right wall 413 that corresponds to physical right wall 113. The virtual front wall 411 includes a group of soft keys, portraying, for example, element 421 depicting a traditional showerhead and corresponding to physical showerhead 121, elements 422 depicting body sprays and corresponding to physical body sprays 122, and element 423 depicting a handshower and corresponding to physical handshower 123.

According to an exemplary embodiment, the layout of the virtual shower 410 may be altered or programmed according to the custom setup of the specific, corresponding physical shower enclosure 110 it represents. The graphical user interface may be programmed by the user or an installer, such that the virtual shower 410 displays multiple elements representing shower outlets, wall breaks, walls, and a ceiling. For example, a grid running five across and four vertically may provide spaces for twenty elements representing shower outlets to be displayed. According to other exemplary embodiments, more or fewer spaces for elements may be provided (e.g., 24 or more spaces, or 16 and fewer spaces), a grid of different dimensions may be provided (e.g., 3×5, or 6×6), or elements may be placed freely (i.e., without pre-defined spaces or a grid).

According to an exemplary embodiment, graphics may be used to indicate that correspond to corners 116 of the physical shower enclosure 110. For example, virtual front wall 411, virtual left wall 412, and virtual right wall 413 may be outlined, such that gaps between the outlines of virtual walls 411, 412, and 413 indicate wall breaks that correspond to corners 116 of the physical shower enclosure 110. According to other exemplary embodiments, virtual walls may be indicated by other manners instead of, or in addition to, outlines (e.g., backgrounds with different colors, shading patterns, perspective views of showerheads), and wall breaks may be indicated by other manners instead of, or in addition to, gaps between virtual walls (e.g., lines, intersection of virtual walls with different colors or shading patterns).

According to an exemplary embodiment, if usable space on the electronic display is insufficient to represent the physical shower 100 in one view of the virtual shower 410, additional virtual walls may be provided. The additional virtual walls may be hidden from view and navigated to by pressing navigation soft key elements (e.g., soft key 451, which navigates to the ceiling) and/or paging representations depicted, for example, by arrows. By pressing the navigation elements, additional virtual walls or a virtual ceiling 415 are revealed. According to an exemplary embodiment, the virtual shower 410 may include five virtual walls, each having twenty pre-defined spaces for elements representing shower outlets, and one virtual ceiling, also having twenty pre-defined spaces for elements. According to other exemplary embodiments, the virtual shower 410 may include more or fewer virtual walls (e.g., more than 6, or fewer than 4), virtual walls having varying numbers of icon spaces (e.g., a virtual front wall having twelve icon spaces, virtual left and right walls each having three icon spaces), more or fewer virtual ceilings (e.g., 2 or more, or zero) with more or fewer icon spaces, or any combination thereof.

According to another exemplary embodiment, instead of displaying a grid of graphical user interface elements, the virtual shower may be implemented by using a digital photograph and/or suitable digital illustration to represent the shower enclosure 110. In this example, controls of the various outlets may be affected through use of hot-spot interaction with the digital photograph and/or illustration, wherein portions of the photograph or illustration are selected to behave as soft keys.

According to an exemplary embodiment, the user may control the various physical shower outlets (e.g., 121, 122, 123 shown in FIG. 1) from the control panel through the graphical user interface. For example, the user can navigate through the different shower outlet icons depicted on the graphical user interface shown on the home screen 462 and perform various functions, such as, for example, turning on/off the flow of water to each physical shower outlet, controlling the specific temperature of the shower outlets, and/or enabling advanced features such as the pulsing of the physical shower outlets, such as to provide a massage experience. For example, the physical showerhead 121 may initially be "off" as indicated by element 421, which does not have the interior portion of the icon shaded. The user may "touch" element 421 to turn on the water flow to the corresponding physical showerhead 121, thereby turning the showerhead 421 "ON" (i.e., having water flow to the showerhead 121). Each of the shower outlet icons 421, 422, 423 may be illustrated as "OFF" or "ON" via any suitable graphic, including as illustrated, by shading the interior of the depicted graphic, and may be touched to turn off or on their associated physical shower outlets 121, 122, 123.

Figure 4B:
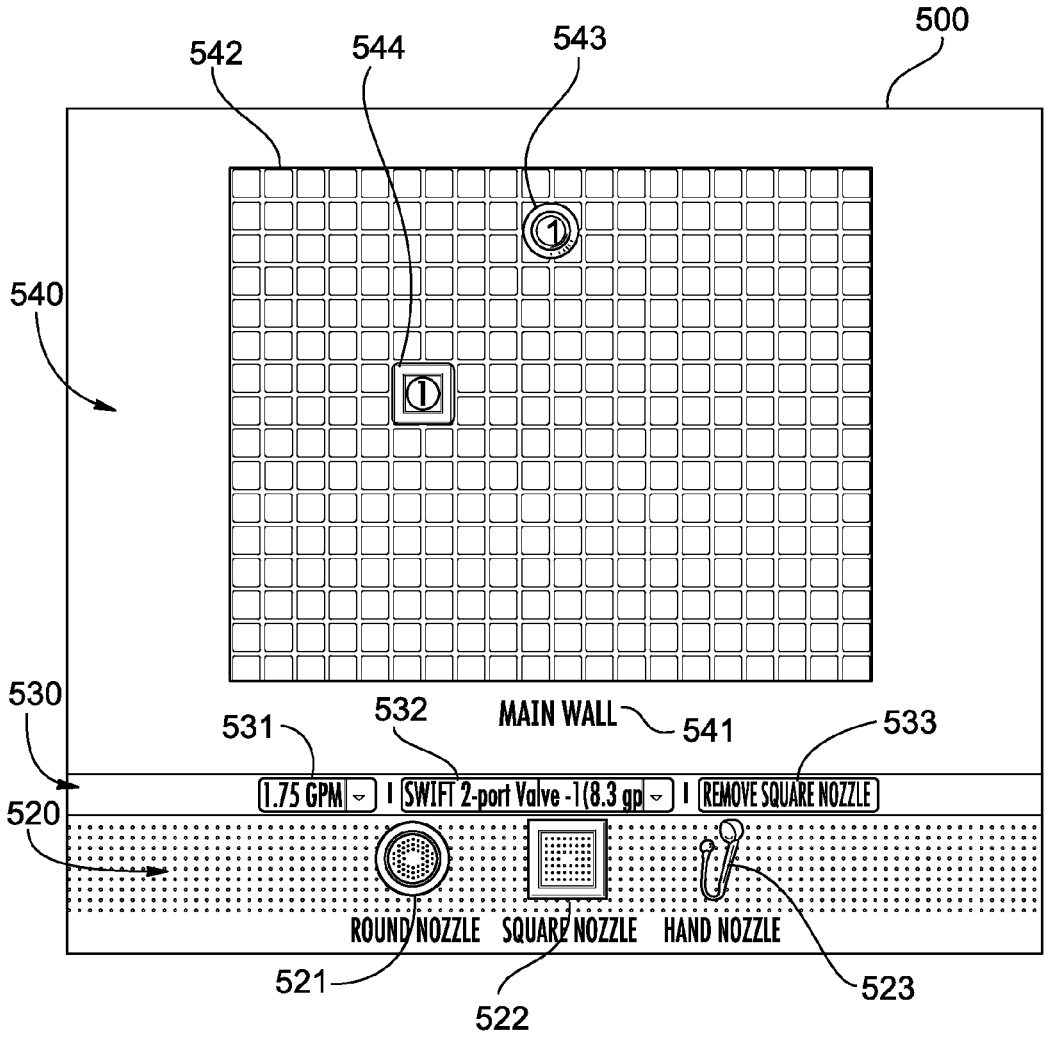
FIG. 4B is an illustration of a programming screen for the graphical representation of the shower layout according to an exemplary embodiment.

Referring now to FIG. 4B, according to an exemplary embodiment, the virtual shower may be programmed by an installer using a separate computer, such as a laptop that includes programming software. The programming software prompts the installer to specify the number of physical walls in the specific shower, allows the installer to customize virtual walls that correspond to each physical wall by placing elements corresponding to shower outlets on the physical walls, and creates a virtual shower that can then be uploaded to the control panel and displayed on the electronic display. According to other exemplary embodiments, the virtual shower may be programmed with software on the control panel, and may be customized by the user.

According to one exemplary embodiment, the programming screen 500 generally includes an element catalog 520, linking control section 530, and placement section 540 including a layout grid 542. The catalog 520 provides the installer with graphical user interface elements that may be used to represent shower outlets, such as a round nozzle 521, square nozzle 522, and hand nozzle 523. The installer may then drag and drop the elements into the layout grid 542 (i.e., select an element from the catalog 520, and position the element on the grid 542). For example, the installer may select round nozzle elements 521 to represent showerheads or rainheads, square nozzle elements 522 to represent body sprays, and the hand nozzle element 523 to represent handshowers. The grid 542 provides locations for the installer to position the elements 521, 522, 523 relative to each other, such as placement of element 543 relative to element 544, on each virtual wall. Each virtual wall that the installer is currently configuring may be indicated by a label 541. The grid 542 also provides horizontal lines and vertical lines, which may be selected by the installer to define virtual walls, a virtual ceiling, and wall breaks in the virtual shower that correspond to a physical shower. The linking controls 530 enable the installer to link and specify the shower outlet that corresponds to each graphical user interface element. For example, element 544 is selected for specifying and linking, as may be indicated by a selection label 545. Flow menu 531 allows the installer to specify the flow rate of the physical shower outlet. Valve menu 532 allows the installer to specify the digital valve and outlet valve that control the physical shower outlet. Remove key 533 allows the installer to remove an element from the grid 542, for example, if he/she wishes to display an element with a different shape. Once the installer completes positioning the elements and linking the elements to corresponding physical shower outlets, the installer saves the virtual shower and uploads it to the control system or control panel to display on the electronic display. In this manner, the virtual shower is created by dragging and dropping elements into two-dimensional grids representing virtual walls, the virtual walls then being positioned or arranged relative to each other to create a representation of a three-dimensional shower. According to another exemplary embodiment, the walls are first positioned or arranged relative to each other to provide the representation of a three-dimensional representation, and then the elements are dragged and dropped into each wall of the representation.

Referring again to FIG. 4, according to an exemplary embodiment, the display displays a graphical user interface having a home screen 462 that includes a group of elements 430 corresponding to systems or modules. Each of the elements 430 represents and is indicative of a corresponding shower system (e.g., water, steam, music, lighting) or software program module (e.g., massage, temperature therapy, temperature zones, and experiences). When a user presses one of the elements 430, a control screen for a corresponding system or module appears on the graphical user interface. Each control screen allows the user to select and activate particular saved settings, edit saved settings, and create and save new settings related to the systems or modules. Each program module is discussed below.

Figure 3:
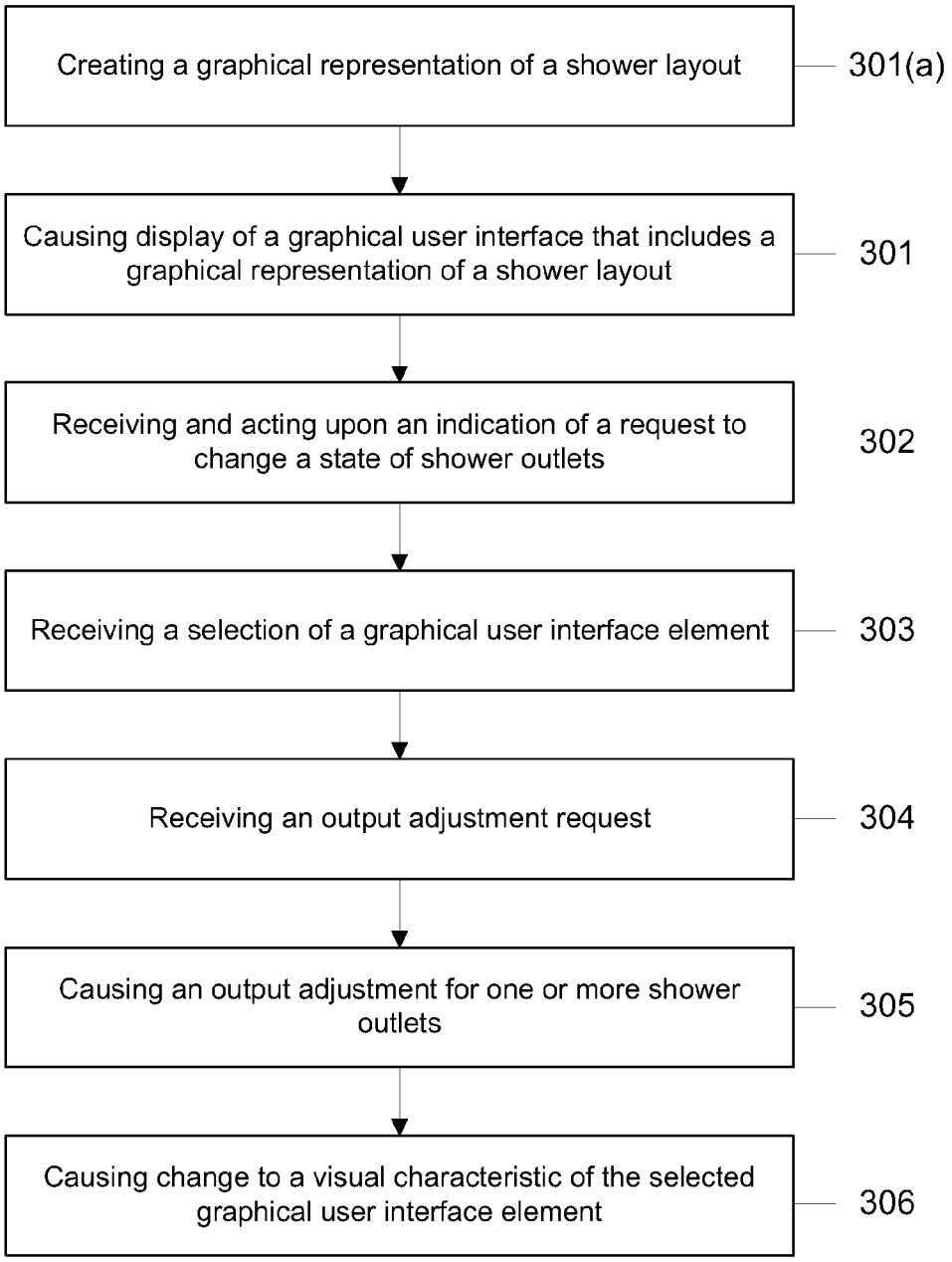
FIG. 3 is a flow diagram of a method for controlling shower outlets through a graphical representation of a shower layout according to an exemplary embodiment.

Now referring to FIG. 3, a method for controlling shower outlets is described. According to one exemplary embodiment, the method includes the steps of:

causing display of a graphical user interface that includes a graphical representation of a shower layout (e.g., displaying the virtual shower 410 shown in FIG. 4 on the electronic display 162 in FIG. 1) and a graphical representation of the shower outlets (e.g., the elements 421, 422, and 423 in FIG. 4) (Step 301), and receiving and acting upon an indication of a request to change a state of the shower outlets (e.g., the showerhead 121, body sprays 122, and handshower 123 in FIG. 1) (Step 302). The graphical representation of shower outlets may include, for example, graphical user interface elements that are associated with one or more of the shower outlets. The indication of a request to change a state of the shower outlets may, for example, be a user input (e.g., through the hard keys or electronic display), or be generated internally by the control system according to various software and in response to other inputs (e.g., from software modules or shower systems). The acting upon an indication of a request may, for example, include processing the request and/or sending a signal (e.g., to the display or shower systems).

According to one exemplary embodiment, the method also includes: receiving a selection of one of the graphical user interface elements (Step 303), receiving an output adjustment request for the selected graphical user interface element (Step 304), and causing an output adjustment for the one or more shower outlets associated with the selected graphical user interface element (Step 305). The selection may be a user input (e.g., a user touching the graphical user interface element on the electronic display 162 of FIG. 1 associated with the shower outlets the user wishes to control). The output adjustment request may, for example, be changing the temperature or flow of water through the shower outlets associated with the selected graphical user interface element.

According to one exemplary embodiment, the method may also include: causing change to a visual characteristic of the selected graphical user interface element (Step 306). This change, for example, may be a change of the shading or background of the graphical user interface element to indicate a change in water flow through the shower outlet associated with the selected graphical user interface element.

According to one exemplary embodiment, the method may also include: creating the graphical representation of a shower layout according to a layout of a specific shower (e.g., the shower 100 in FIG. 1) (Step 301(*a*)). Creating the graphical representation may, for example, include (a) choosing graphical user interface elements according to corresponding types of shower outlets, (b) linking or associating the elements with physical shower outlets, and (c) placing the elements according to the position of the shower outlets in the specific shower.

Creating the graphical representation may also include, for example, defining a number of virtual walls (i.e., graphical representations of walls in the physical shower), defining a size for each virtual wall (e.g., the number of positions for displaying an element, such as 5×1, 4×2, or defining dimensions (e.g., 3"×2"), or providing other graphics indicative of physical features in the specific shower (e.g., outlining walls, highlighting walls, coloring walls, providing lines to indicate corners). According to another exemplary embodiment, creating the graphical representation may include using one or more photographs of the specific shower, or of another physical shower, creating hot spots (i.e., portions of the screen to act as soft keys to receive user input), and linking the hot spots to corresponding shower outlets.

Figure 5:
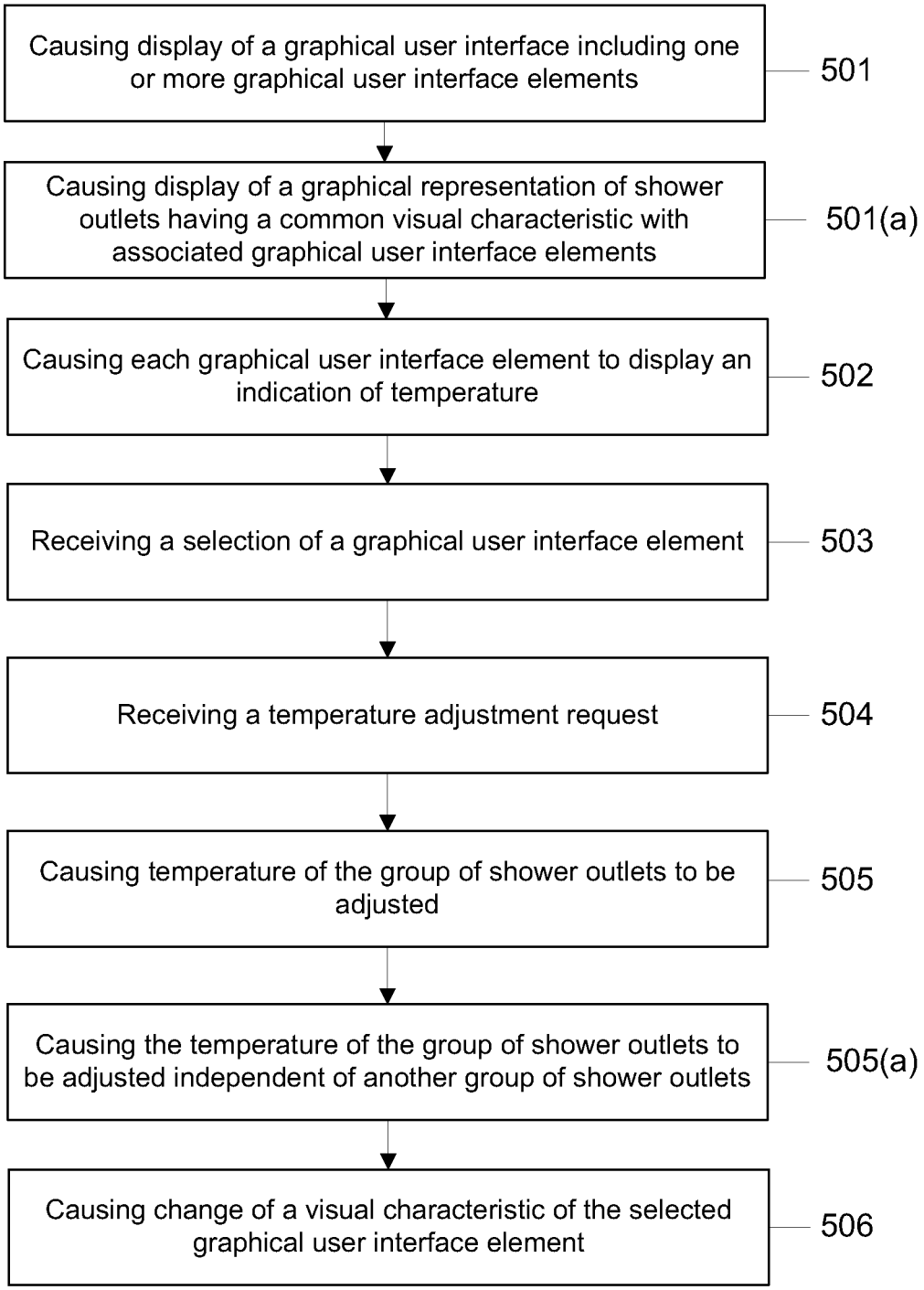
FIG. 5 is a flow diagram of a method for controlling shower outlets through a temperature zone module according to an exemplary embodiment.
Figure 6:
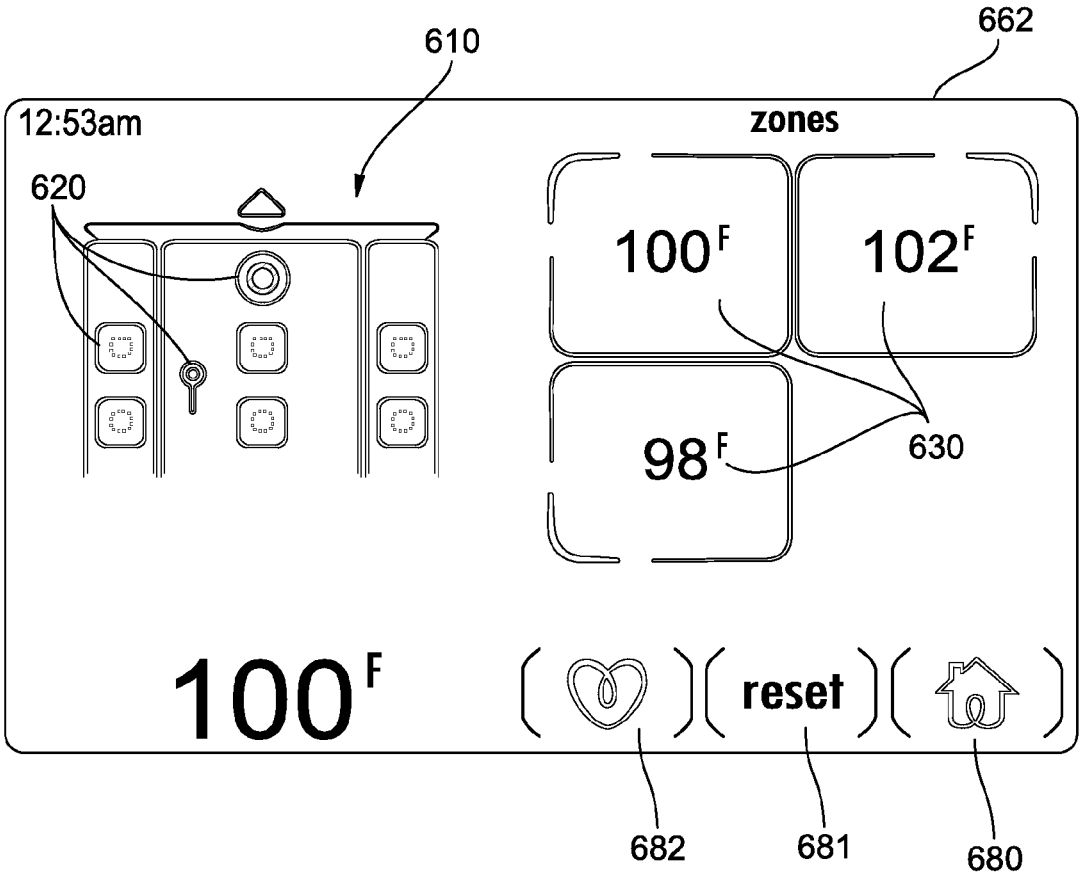
FIG. 6 is an illustration of a temperature zone control screen according to an exemplary embodiment.

Now referring to FIG. 5 and FIG. 6, according to an exemplary embodiment, a method and system for temperature zone program module is provided, which allows the user to identify and change the water temperature of physical showerheads whose temperature can or must be changed as a group.

Referring again to FIG. 4, the temperature zone program module is selectable through the soft key element 433. Now referring to FIG. 6, the graphical user interface displays a temperature zone control screen 662. The control screen 662 allows a user to separately control the temperature of a number of digital valves (e.g., 1-4) with each digital valve being coupled to one or more shower outlets (e.g., 1-8). In this manner, the temperature of the shower outlets connected to an individual digital valve may be controlled collectively with each other and independently of those shower outlets connected to a different digital valve.

According to an exemplary embodiment, the temperature zone control screen 662 displays a virtual shower 610 including elements 620 representing shower outlets and a group of elements 630 representing temperature zones. Each zone element 630 corresponds to a group of elements representing shower outlets whose output conditions are changed collectively. According to an exemplary embodiment, each zone element 630 has a visual characteristic that corresponds to a visual characteristic of its associated elements representing shower outlets. The visual characteristic for the zone element 630 and shower outlet elements, for example, may be the same (i.e., matched), such as having a common color, pattern, background, or shading. In this manner, the graphical user interface indicates to the user which shower outlets are grouped together to have their temperatures changed collectively.

According to an exemplary embodiment, when the user selects a temperature zone element 630, selection is also indicated on the corresponding shower outlet elements. For example, the elements may be highlighted, brightened, outlined, or increased in size. The user may then change the temperature of the group of shower outlets corresponding to the selected zone element 630, for example, by pressing hard keys or soft keys that may be provided in the graphical user interface.

According to an exemplary embodiment, each temperature zone element 630 may also display an indication of water temperature. According to an exemplary embodiment, each zone element 630 displays alphanumeric text indicating temperature (e.g., "100 F"). According to other exemplary embodiments, the indicator is a dial, a slider, or any other graphic capable of indicating temperature. According to yet another exemplary embodiment, the indicator may be interactive, such that the user may move a part of the icon or perform a gesture for changing the icon (e.g., rotating a dial, moving a slider, etc.).

According to an exemplary embodiment, zone elements 630 may be provided for any group of shower outlets having a common physical characteristic, such as being coupled to the same outlet valve, being of a common type (e.g., shower head, body spray, handshower), being disposed in a common position (e.g., wall, height), or common flow (e.g., high pressure, low pressure, no flow, pulsating flow). The zone element 630 associated with each group may also include a visual characteristic corresponding to a visual characteristic of the shower outlet elements, such as common shape, color, background, or shading. Grouping based on physical characteristic may be dictated by the physical arrangement of the shower outlets (e.g., common valve, placement on wall or at a certain height), or may be user defined (e.g., all shower outlets having pulsating flow, all body sprays).

According to an exemplary embodiment, the temperature zone control screen 662 may also provide additional soft keys. For example, a soft key 680 may be provided to return to the home screen 462. Soft key 681 may be provided to reset or undo any changes the user may have made. Soft key 682 may also be provided for the user to save the current temperature zone configuration. Other combinations of additional soft keys may be provided, for example, including more or fewer soft keys, soft keys with different functions, and/or soft keys with different visual characteristics.

Now referring to FIG. 5, a method for controlling shower outlets is described. According to one exemplary embodiment, the method includes the steps of: causing display of a graphical user interface including a plurality of graphical user interface elements (e.g., the elements 630 in FIG. 6 being displaying on the electronic display 162 of FIG. 1), each graphical user interface element associated with a group of shower outlets (e.g., the showerhead 121, body sprays 122, and/or handshower 123 in FIG. 1) (Step 501), and causing each graphical user interface element to display an indication of temperature (e.g., the alphanumeric text of elements 630 in FIG. 6) of its associated group of shower outlets (Step 502). The indication of temperature may, for example, include alphanumeric text (i.e., a written label; e.g., "100 F"), graphics (e.g., a dial, slider, or thermometer), or any combination thereof.

According to one exemplary embodiment, the method also includes: receiving a selection of one of the graphical user interface elements (Step 503), receiving a temperature adjustment request for the selected graphical user interface elements (Step 504), and causing temperature of the group of shower outlets to be adjusted in response to the receive temperature adjustment (Step 505). The selection and temperature adjustment request may, for example, be received from the user (e.g., through the hard keys or electronic display). Causing a temperature adjustment may, for example, include sending a signal to a digital valve to adjust intake of hot and cold water.

According to one exemplary embodiment, the method may also include: causing change of a visual characteristic of the selected graphical user interface element (Step 506). Change of a visual characteristic may, for example, include changing color, size, brightness, shading, or background of the graphical user interface element to indicate selection or changing the alphanumeric text, moving the graphics (e.g., turning the dial, moving the slider or thermometer) to indicate a change in temperature.

According to other exemplary embodiments, the method may also include: causing the temperature of the group of shower outlets to be adjusted independent of another group of shower outlets (Step 505(*a*)), and/or causing display of a graphical representation of shower outlets associated with the graphical user interface elements, the graphical representation having a common visual characteristic with the graphical user interface elements (Step 501(*a*)). The common visual characteristic may, for example, be color, shading, background, or highlighting.

Figure 7:
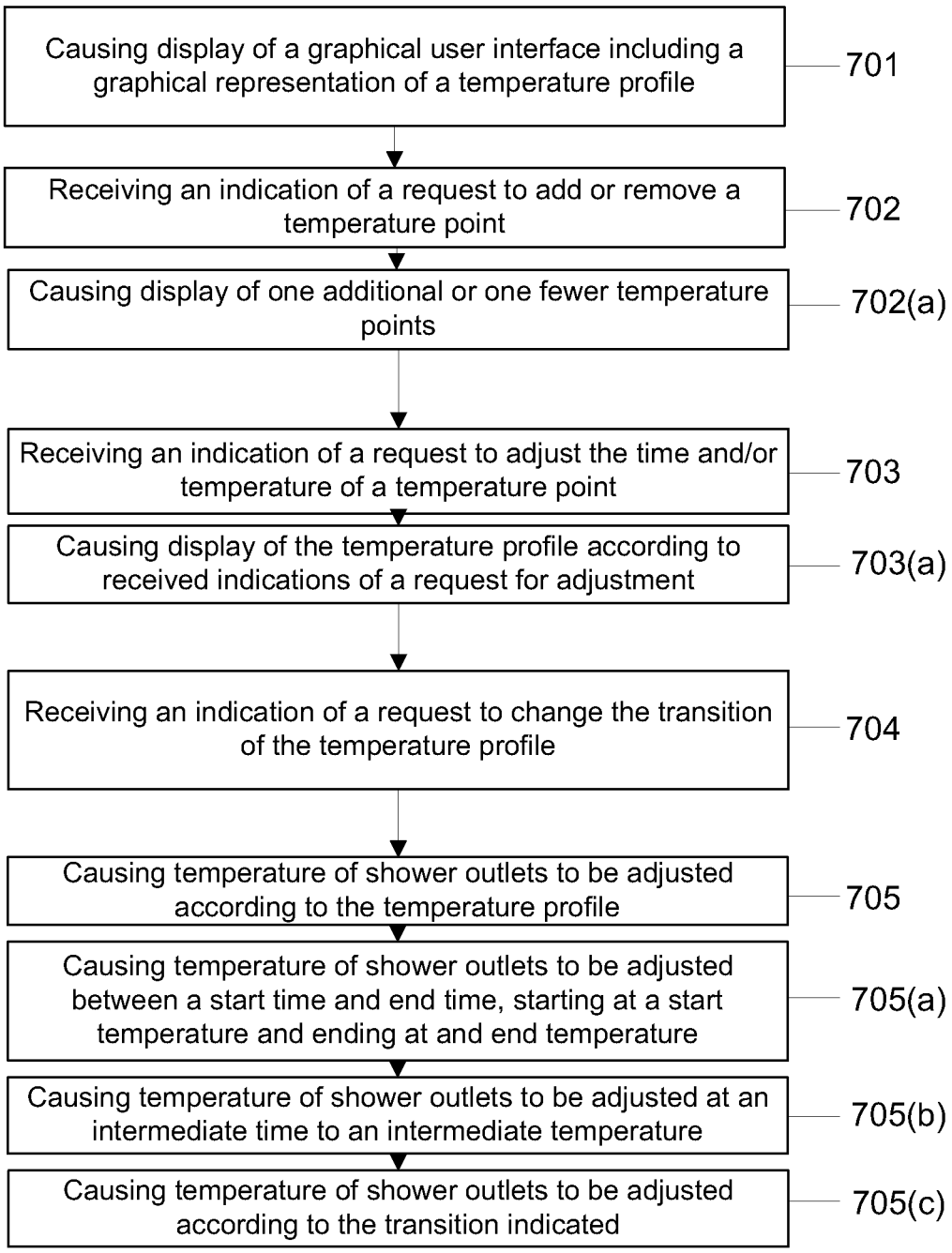
FIG. 7 is a flow diagram of a method for controlling shower outlets through a temperature therapy module according to an exemplary embodiment.
Figure 8:
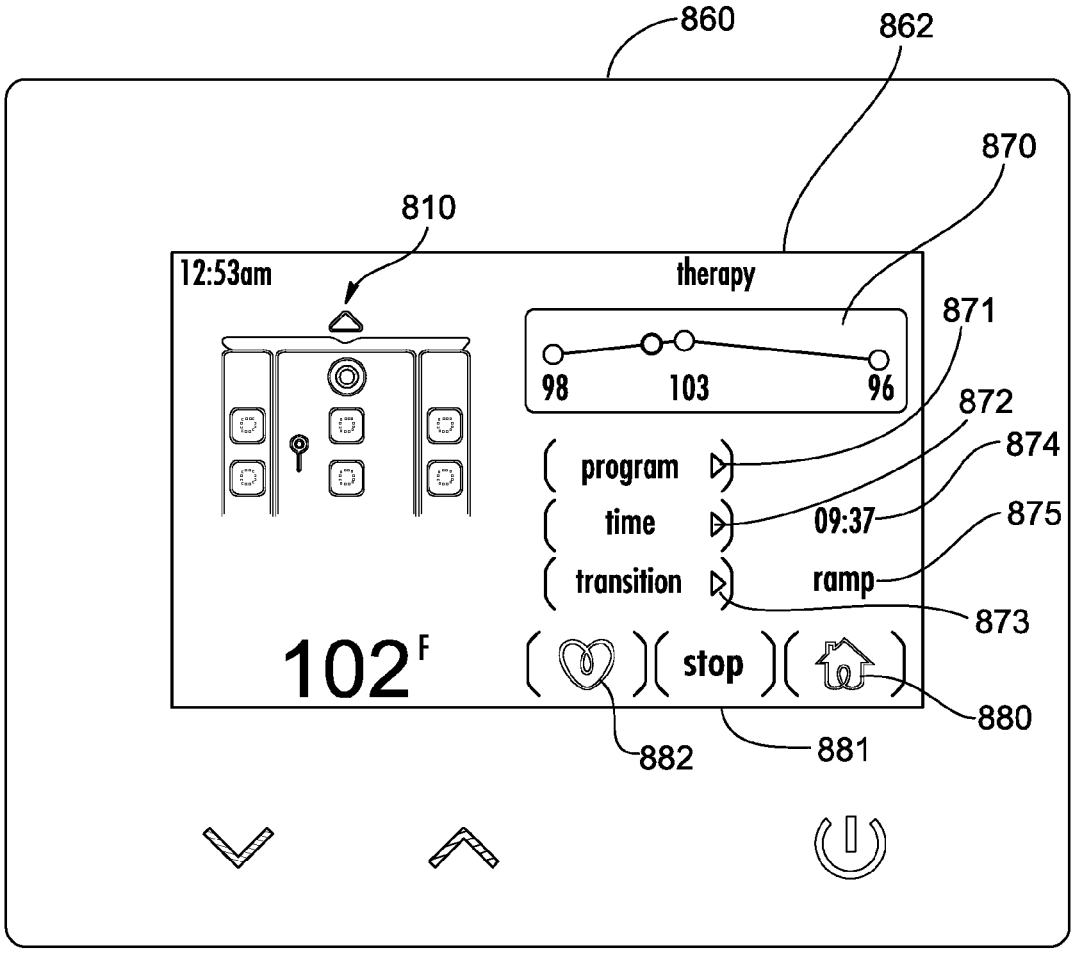
FIG. 8 is an illustration of a temperature therapy control screen according to an exemplary embodiment.
Figure 9:
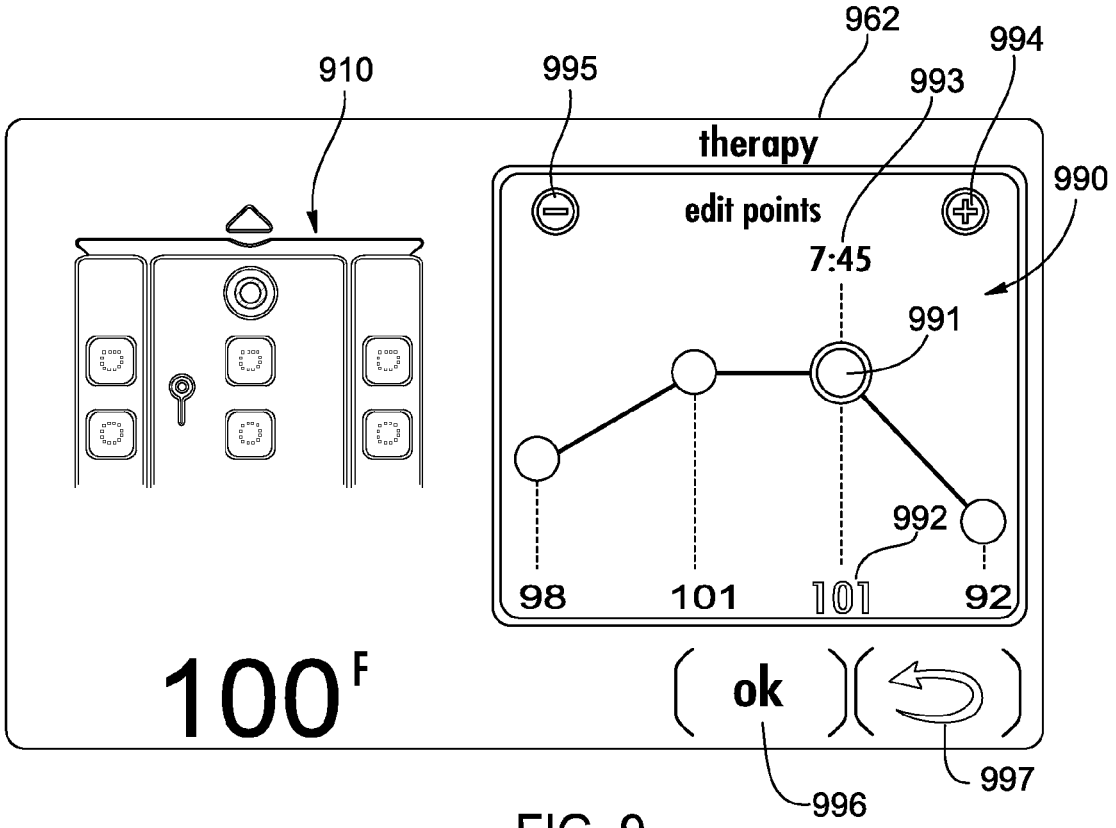
FIG. 9 is an illustration of a screen for modifying a temperature profile according to an exemplary embodiment.

Now referring to FIG. 7, FIG. 8, and FIG. 9, according to an exemplary embodiment, a method and system for a temperature therapy program module is provided, which permits the construction of a customized temperature profile for a desired duration of a shower. For instance, the temperature profile module enables the user to input and/or edit the desired duration of a shower and then create a temperature profile that can increase and/or decrease the water temperature at specified times determined by the user. According to an exemplary embodiment, the user is able to control the details of the temperature experience to provide temperatures in any desired pattern. For example, a user may program a steady increase or decrease in temperature between two user inputted temperature points, a user may request an increase in temperature, followed by a sharp decrease, such as is typically employed by European spas, the user may program a modulating temperature that fluctuates between hot and cold like the hills of a roller coaster, and/or any other desirable pattern profile. According to one exemplary embodiment, different temperature therapy profiles may be provided for different groups of shower outlets. According to another exemplary embodiment, one temperature profile is provided for all groups of active shower outlets.

Referring again to FIG. 4, according to an exemplary embodiment, when a user touches the temperature therapy module icon 432 in the home screen 462, a graphical user interface displays a temperature therapy control screen (862 in FIG. 8). Referring to FIG. 8, the control panel 860 is illustrated with the graphical user interface displaying a temperature therapy control screen 862. The temperature therapy control screen 862 includes graphical user interface elements related to temperature therapy controls, including a temperature profile element 870, a program selection element 871, a time selection element 872, and a transition element 873. The temperature profile element 870 depicts the temperature profile for the profile selected, generally showing a series of temperature points connected by lines and numeric temperature labels for one or more temperature points. The temperature points may, for example, be displayed in positions relative to intersecting axes to indicate relative temperature and time of the temperature points. The program selection, time selection, and transition elements 871, 872, 873 are each labeled by alphanumeric characters. The temperature therapy control screen 862 also includes a series of soft keys related to broader control panel functions, including a home screen element 880 depicting a house, a play/stop element 881 displaying either the word "play" or "stop," and a "save" element 882 depicting a heart.

According to an exemplary embodiment, to recall a saved temperature profile to run, the user presses the program selection element 871. A list of saved temperature profiles will appear, which may be represented, for example, by elements depicting a temperature profile, elements having other designs, a series of alphanumeric characters, or a combination thereof. The user may then select a desired temperature profile by pressing on the appropriate element. To play a saved profile or stop a running profile, the user then presses the "stop"/"play" soft key element 881. While a saved temperature profile is running, the time remaining 874 in the temperature profile will be displayed next to the time selection element 872. Additionally, the temperature profile element 870 may indicate where in the temperature profile the user is, such as by a vertical line that moves horizontally across the temperature profile.

According to an exemplary embodiment, the user may create new temperature profiles. When a user touches the temperature profile element 870, an edit points screen (962 in FIG. 9) appears in the graphical user interface. Now referring to FIG. 9, the graphical user interface displays the edit points screen 962, depicting a virtual shower 910 and a temperature profile 990. The temperature profile 990 includes a series of two or more temperature points or nodes 991 that are positioned relative to each other to indicate relative temperature and time, vertically for temperature and horizontally for time. The user may change the temperature of a particular node 991 by touching and sliding the node up or down, the specific temperature being indicated by temperature label 992 in alphanumeric characters. The user may change the time position of a particular node by touching and sliding the node left or right, the specific time being indicated by a time label 993 in alphanumeric characters. According to other exemplary embodiments, the nodes may instead be moved by the user in other manners. For example, the user may touch a node 991 to select it, the node 991 then appearing larger and/or brighter than non-selected nodes. Hard keys and/or additional soft keys, corresponding to increases and decreases in temperature or time, may then be pressed or touched by the user.

According to an exemplary embodiment, the user may select the number of temperature nodes 991 to be included in the temperature profile 990. The edit points screen 962 in the graphical user interface includes an add node soft key 994 including a plus sign icon (i.e., "+") and a delete node soft key 995 including a minus sign icon (i.e., "–"), which the user may touch to add or delete nodes between two end nodes. According to an exemplary embodiment, the user may choose between two and five nodes. According to another exemplary embodiment, the user may choose more than five nodes.

According to an exemplary embodiment, the edit points screen may also include an "ok" soft key 996, which, when touched by the user, saves the displayed temperature profile and returns the graphical user interface to the temperature therapy control screen. The edit points screen may also provide a "return" soft key 997 depicting a curved arrow, which when touched by user, returns the graphical user interface to the temperature profile control screen 862 without changing the temperature profile.

According to an exemplary embodiment, the user may determine the total time duration of a temperature profile. Referring again to FIG. 8, when the user touches the time selection icon 872, the user may then select a desired profile time. For example, a list of incremental times may appear, and the user may select a desired time duration by touching the corresponding time listed. According to another example, a digital clock will appear, and the user may press hard keys or soft keys, which are representative of positive or negative changes in time (e.g., with arrows or plus and minus signs), until the desired time duration is reached. The user may then return to the graphical user interface to the temperature therapy control screen, for example, by pressing the digital clock or an "ok" soft key that may be provided.

According to an exemplary embodiment, the user may also determine the temperature transition between nodes. Referring again to FIG. 8, when the user touches the transition icon 873, the user may then select a desired transition. For example, a list of transitions may appear, such as "ramp" indicating a gradual transition or "step" indicating an abrupt transition. The user then touches the desired transition and a transition label 875 appears next to the transition icon 873.

According to an exemplary embodiment, the user may save custom temperature profiles. Once the user has set each desired parameter (e.g., number of nodes, nodes time and temperature positions, and transitions), the user touches the save element 882 to save the temperature profile into memory. The user may then be prompted to label the temperature profile, such as with an icon or alphanumeric, so that the saved temperature profile may be later recalled and run again.

According to different exemplary embodiments, each temperature therapy profile may be applied to the entire shower system (i.e., all operating physical showerheads), or may alternatively by programmed to control at least one showerhead and/or group of showerheads as desired, such as through the virtual shower 810 displayed in the graphical user interface.

Now referring to FIG. 7, a method for controlling shower outlets is described. According to one exemplary embodiment, the method includes the steps of: causing display of a graphical user interface including a graphical representation of a temperature profile (e.g., the element 870 in FIG. 8 or 990 in FIG. 9 being displayed on the electronic display 162 of FIG. 1) (Step 701), and causing temperature of the shower outlets (e.g., the showerhead 121, body sprays 122, and/or handshower 123 in FIG. 1) to be adjusted according to the temperature profile (Step 705). The temperature profile includes at least two temperature points that are adjustable in time and temperature (e.g., the temperature points may be start and end temperature points, each with a temperature, a duration of time between them, and the temperatures and duration being adjustable). Causing temperature adjustment may, for example, sending a signal to a digital valve to adjust the proportionate mix of incoming hot and cold water.

According to one exemplary embodiment, the method also includes receiving an indication of a request to add or remove a temperature point (e.g., the temperature point 991 in FIG. 9) (Step 702), and causing display of one additional or one fewer temperature points. The request may, for example, be user-specified and received through the hard keys or electronic display of the control panel. The user may, for example, request that the number of temperature points be increased from two to three temperature points or decreased from four to three temperature points.

According to one exemplary embodiment, the method includes receiving an indication of a request to adjust the time and/or temperature of a temperature point (e.g., by touching the add or remove node soft keys 994, 995 in FIG. 9) (Step 703). The method may also include causing display of the temperature profile according to the requested adjustment of time or temperature. The request may, for example, be user-specified and be received through the hard keys or electronic display of the control panel. The user may, for example, request that the total shower duration be increased, thus changing the time of an end point.

According to one exemplary embodiment, the method includes receiving an indication of a request to change the transition for the temperature profile (e.g., by touching the transition icon 873 in FIG. 8) (Step 704). The request may, for example, be user-specified and be received through the hard keys or electronic display of the control panel. The transition may, for example, be a ramp transition corresponding to a gradual change in temperature between two temperature points or be a step transition corresponding to an abrupt change in temperature between two temperature points.

According to an exemplary embodiment, the method includes causing temperature of shower outlets to be adjusted according to the temperature profile 705. Causing adjustment may, for example, include sending a signal to a digital valve to adjust the proportionate mix of hot and cold water received. The adjustment of temperature may, for example, include adjusting between a start time and an end time, starting at a start temperature and ending at an end temperature (Step 705(*a*)). The adjustment may, for example, also include adjusting to an intermediate temperature at an intermediate time between the start and end times (Step 705(*b*)). The adjustment may, for example, also include adjusting the temperature gradually or abruptly according to the transition indication (Step 705(*c*)).

According to one exemplary embodiment of the method, the steps may be performed in numerical order. According to other exemplary embodiments, the steps may be performed in other orders, other combinations of steps, and other combinations of steps in other orders.

According to an exemplary embodiment, an experiences module is provided, which allows the user to save and recall a combination of settings for the shower systems and program modules. In the experience module, the user can select specific saved settings from each of the available individual systems or modules (e.g., temperature, steam, music, temperature therapy, etc.), and then save them together as one entire showering experience for later "playback." For example, a user can create a unique experience by combining a music playlist from the music module, a massage setting from the massage module, a steam setting from the steam module, and a lighting setting from the lighting module. The user can save the use of all of these settings together under one named experience and when the user initiates the experience, all of the settings will run to create a unique user defined shower event.

Referring again to FIG. 4, the graphical user interfaces includes an "experiences" element 432. The experiences element 432 depicts a series of illustrated hearts (i.e., representative of users' saved or favorite experiences). When a user presses the experiences feature element 432 from the home screen 462, the graphical user interface displays an experiences control screen (1162 in FIG. 11).

Figure 11:
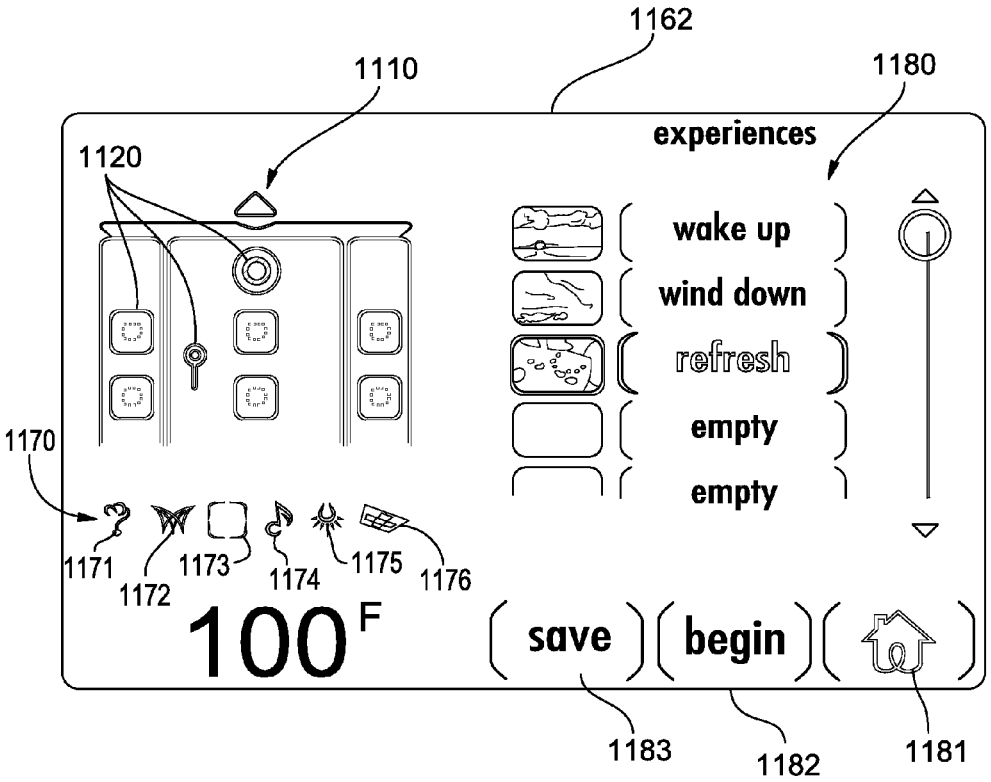
FIG. 11 is an illustration of an experiences control screen according to an exemplary embodiment.
Figure 12:
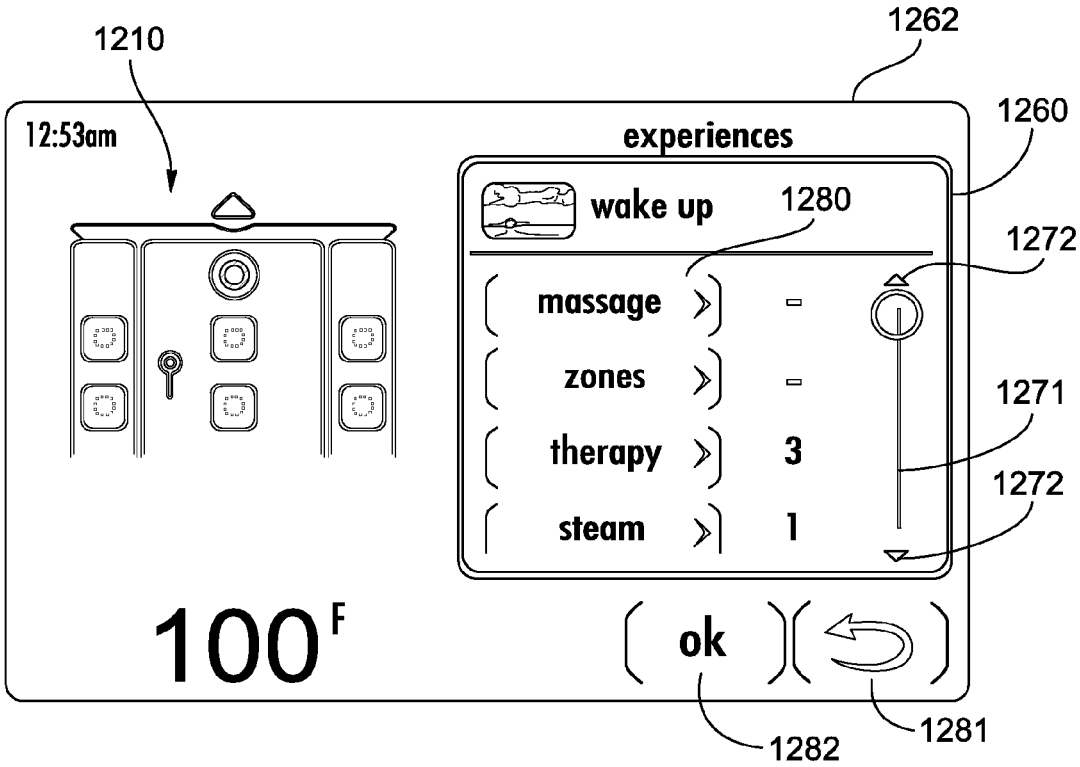
FIG. 12 is an illustration of a screen for selecting systems or modules for the experiences module according to an exemplary embodiment.

Referring now to FIG. 11, according to an exemplary embodiment, the experiences control screen 1162 displays a group of elements 1180 representing saved experiences, each element 1180 including an icon and alphanumeric labels, a group of subsystem/module elements 1170, a group of control panel function icons, and a virtual shower 1110 including a group of shower outlet elements 1120.

According to an exemplary embodiment, the user may select a particular saved experience by touching the associated experience element 1180. Selection of a particular experience may be indicated, for example, by boldface alphanumeric text associated with the selected experience, brightened the text and/or elements, increased size of the text and/or elements, outlining of the text and/or element, or any combination thereof, or any other manner sufficient to visually indicate to the user that an experience is selected.

According to an exemplary embodiment, when an experience is selected, a group of elements 1170 representing systems or modules are displayed for those systems or modules that are active in the selected experience. The system/module elements 1170 are configured to visually indicate to the user what system/module corresponds to each element 1170. For example, element 1171 represents the steam system and depicts a swirl rising from a lower point (i.e., indicative of steam rising from an outlet), element 1174 represents the music system and depicts a music note, element 1175 represents the lighting system and depicts a light bulb, and element 1176 depicts represents the ambient rain function and depicts a rain panel. Further, elements 1172, 1173 represent are indicative of, the massage module and temperature zone modules. By displaying system/module elements 1170 that are visually indicative of the systems and modules active for a given experience, the user may quickly and intuitively determine which systems and modules will be turned on for each experience. For example, the user may quickly scroll through each saved experience until finding an experience that includes a desired combination of systems or modules.

According to an exemplary embodiment, when an experience is selected, the experiences control screen 1162 also displays a virtual shower 1110 to indicate for each experience which shower outlets are active and their respective temperature zone. By displaying the virtual shower 1110, including elements 1120 representing shower outlets according to the manner described above, the user may quickly and intuitively determine for each experience which corresponding physical shower outlets are active. Further, by displaying the system and module elements 1170 and the virtual shower 1110, the user may quickly and intuitively determine for each experience which systems and modules are active and which shower outlets are active.

According to an exemplary embodiment, when an experience is selected, the user may start the experience by touching the "begin" soft key 1182. A running experience may be stopped for example, by pressing the "power" hard key, or a "stop" soft key that may be provided in place of the "begin" soft key 1182. Or, the user may select a different experience by touching its associated element 1180 and pressing the "begin" soft key 1182. The user may also return to the home screen by pressing the home soft key 1181, which depicts a house.

Figure 13:
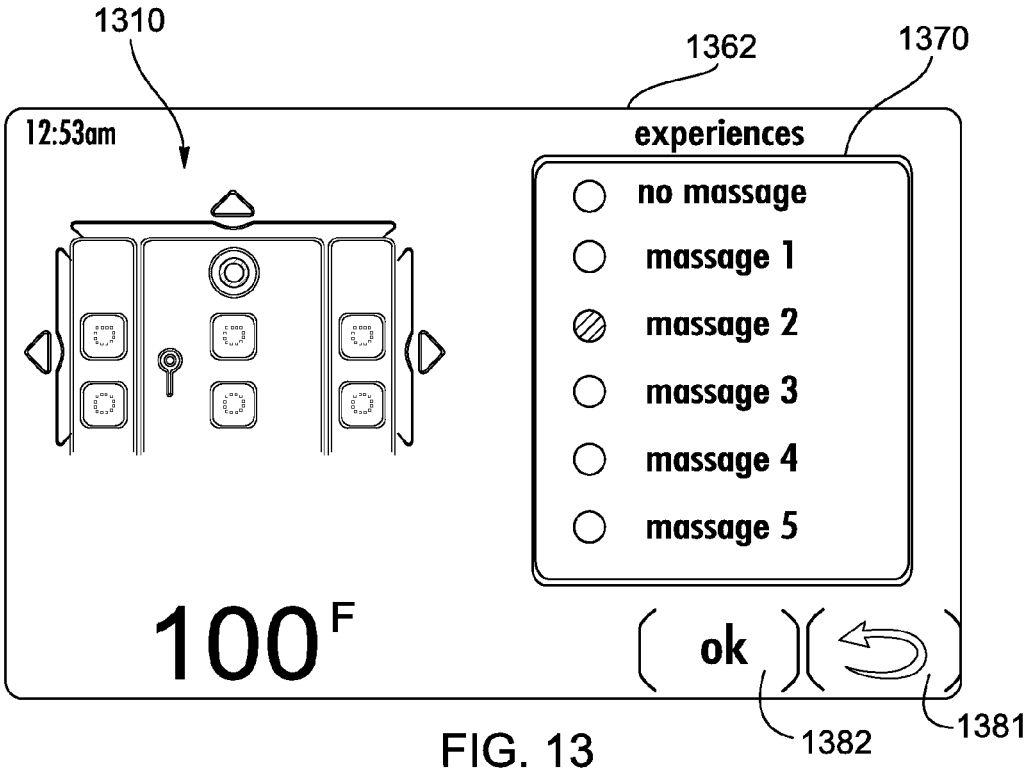
FIG. 13 is an illustration of a screen for selecting a setting for a system or module according to an exemplary embodiment.

According to an exemplary embodiment, when a saved experience is selected, the user may begin editing the experience by touching the "edit"/"save" soft key 1183, which causes the graphical user interface to display an experience edit screen 1262. Or, the user may similarly create a new experience by selecting an "empty" experience element and touching the "edit"/"save" soft key 1183. The experience edit screen 1262 allows a user to compile a series or combination of stored, programmable instructions to create a comprehensive shower experience. For instance, the experience edit screen 1262 displays a menu 1260 including shower systems and program modules to allow the user to create and/or control a variety of different parameters related to the shower systems or modules, such as music, temperature zones, temperature therapy, lighting, steam, massage, or any other suitable parameter. Each system or module is indicated in the menu 1260 by a graphical user interface element that includes an alphanumeric label (e.g., "music," "steam") and/or a graphical image, which the user may select by touching the respective element. The menu may also include a scroll bar 1271 and navigation keys 1272 for navigating the menu to reveal other system/program elements. The experience edit screen 1262 may also display the virtual shower 1210. When a system/feature module is selected, a system or module setting select screen (e.g., 1362 in FIG. 13) is displayed by the graphical user interface.

According to an exemplary embodiment, in the setting select screen 1362 for each of these systems or modules, the graphical user interface includes a menu 1370 that provides the user the ability to save individual settings into an experience, each system or program setting being indicated by an alphanumeric label, a graphical icon, or both. The system or program settings may be pre-programmed (i.e., provided by the manufacturer), or may be user-created, such as within the control screen for the respective system or module. The user may then select a desired setting by pressing the corresponding element in the menu 1370, the selection being indicated, for example, by brightening, highlighting, outlining, or any combination thereof. Once the desired setting is selected, the user may save the setting to the experience by touching the "ok" soft key 1382, or the user may press the "return" key 1381 to return to the experience edit screen without changing the system or program setting for that experience. The graphical user interface then displays the experience edit screen 1262 with a label or figure corresponding to the selected setting next to the system or module 1280 element in the menu 1260.

For example, in the example illustrated in FIG. 11, the user may edit a "wake up" experience profile by selecting the corresponding experience element 1180. The user may then select the massage module, causing the graphical user interface to display a massage setting select screen 1362 that allows the user to select a massage setting. The setting select screen 1362 also depicts a virtual shower 1310. The user may, for example, select to include a "massage 2" setting, such selection being indicated by highlighting, and then press the "ok" soft key 1382 to save the massage setting to the experience and return to the experience edit screen 1262. The user may also edit the "wake up" experience by selecting a setting temperature therapy (e.g., "therapy 3") and for steam (e.g. "steam 1") from the module select screens for the respective module and steam setting select screens. In the experience edit screen 1262, the user then presses the "ok" key 1282 to save the experience, returning the graphical user interface to the experiences select screen 1162. The user may instead return to the experiences select screen 1162 by pressing the "return" soft key 1281 without saving settings. The user may then select the "wake up" experience, and press the "begin" to "playback" the experience.

According to other exemplary embodiments, other screens or tools may be provided in the graphical user interface to communicate information to the user and to receive user inputs. For example, other screens or tools may include pop up boxes, a wizard with series of questions, or other information to guide the user in configuring an experience.

Figure 10:
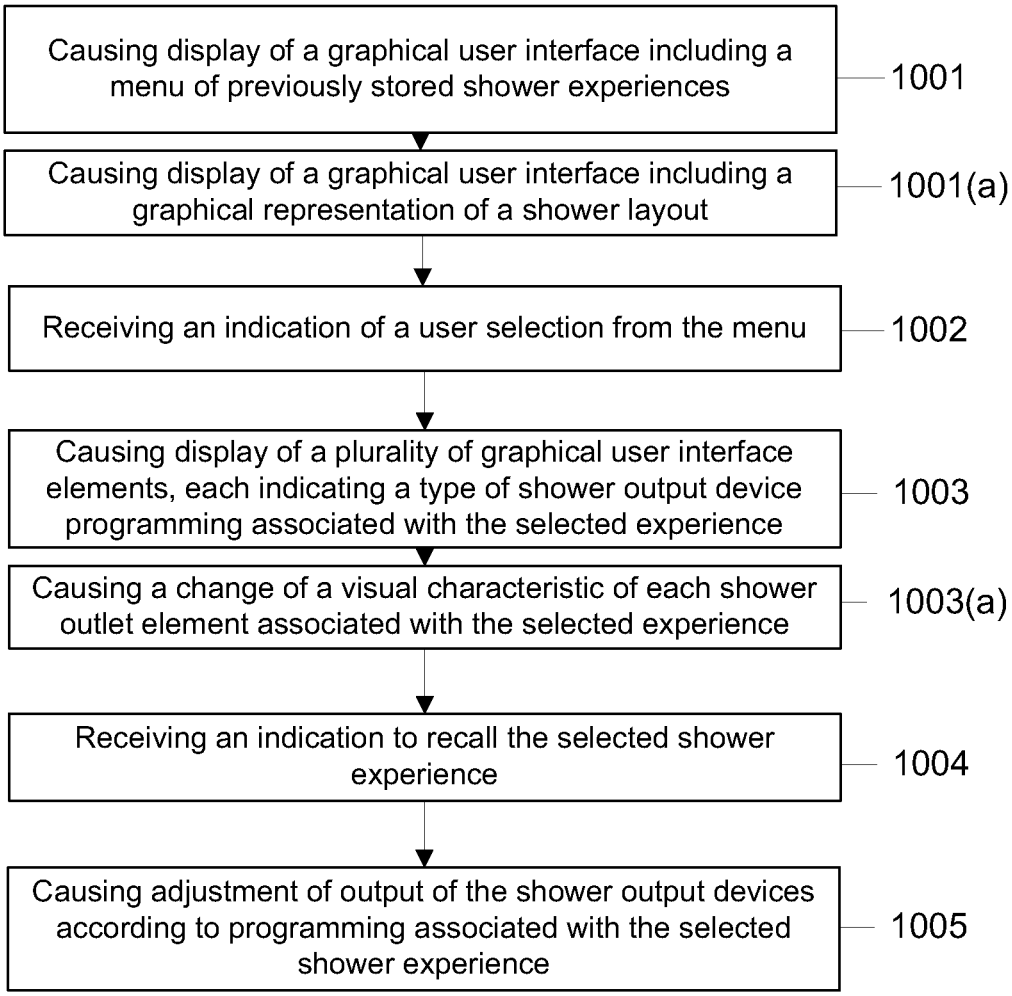
FIG. 10 is a flow diagram of a method for controlling shower output devices through an experiences module according to an exemplary embodiment.

Referring now to FIG. 10, a method is provided for controlling the shower system. According to an exemplary embodiment, the method includes: causing display of a graphical user interface including a menu of previously stored shower experiences (e.g., the menu 1180 in FIG. 11 displayed on the electronic display 162) (Step 1001). The menu may, for example, include elements or alphanumeric text representing each previously stored shower experience. Each shower experience may, for example, include a plurality of user-specified settings for controlling output devices of the shower system. The method also includes: receiving an indication of a user selection from the menu (Step 1002). The indication may, for example, be user-specified and received through hard keys or the electronic display. The method also includes: causing display of a plurality of graphical user interface elements that each indicate a type of shower output device programming associated with the selected shower experience (e.g., the program/module elements 1171 representing steam, and 1172 representing massage in FIG. 11) (Step 1003). The elements may, for example, only be displayed if a corresponding subsystem or module is active for the experience. The elements may, for example, include visual characteristics that are indicative of the type of programming it represents.

According to an exemplary embodiment, the method may include: receiving an indication to recall the selected shower experience (e.g., the "wake up" experience from menu 1180 in FIG. 11) (Step 1004). The indication may, for example, be user-specified and received through the hard keys or electronic display. The method may also include: causing adjustment of output of the shower output devices (e.g., the showerhead 121, steam outlets 131, speakers 141, or lights 151 of FIG. 1) according to the programming associate with the selected shower experience (Step 1005). Causing adjustment may, for example, include sending signals to the various shower subsystems according to the programming. The adjustment of shower output devices may, for example, include sending signals to the various shower subsystems (e.g., water, steam, music, and lighting) to adjust output (e.g., turning on/off, changing temperature/volume, amount) from their output devices (e.g., water from shower outlets, steam from steam outlets, music from speakers, light from lights).

According to an exemplary embodiment, the method may also include: causing display of a graphical user interface that comprises a graphical representation of a shower layout (e.g., the virtual shower 1110 in FIG. 11) (Step 1001(*a*)). The graphical representation may, for example, be a virtual shower with shower outlet elements, the virtual shower and elements representative of a physical shower and shower outlets.

According to an exemplary embodiment, the method may also include: causing a change of a visual characteristic of each shower outlet element (e.g., the elements 1120 in FIG. 11) that represents physical shower outlets associated with the selected shower experience (Step 1003(*a*)). Changing a visual characteristic may, for example, include changing shading of shower outlets that are active for the selected experience or changing color of shower outlets according to temperature zones that are active for the selected experience.

According to an exemplary embodiment, the shower control system may limit the availability of modules to the user, such as to simplify a user's navigation and customization of shower settings. For example, when the user runs a temperature therapy profile, the temperature zone module may not be active. Accordingly, all shower outlets will have the same temperature. Conversely, when the user runs the temperature zone module, the temperature therapy module is inactive. Accordingly, temperatures will not be changed automatically according to a saved temperature profile. Those skilled in the art will recognize that other limitations may be provided on the availability of systems or modules, or that even more customization may be available to the user, within the scope of this disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of control panel and shower control system as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

The present disclosure contemplates methods, systems and program products on memory or other machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A system for controlling shower outlets, comprising:

an electronic display configured to display multiple different graphical user interfaces for controlling the shower outlets, each of the graphical user interfaces comprising a different set of graphical user interface elements;

a controller configured to cause the electronic display to display a graphical user interface, the graphical user interface comprising a plurality of graphical user interface elements;

a first group of one or more shower outlets;

wherein at least one of the graphical user interface elements is a graphical representation of shower layout comprising a first shower outlet element that is associated with the first group of one or more shower outlets, another of the graphical user interface elements is a first zone element that displays an indication of water temperature for the first group of one or more shower outlets, and the first shower outlet element and the first zone element have a first common color indicating that the water temperature displayed by the first zone element applies to the first group of shower outlets.

2. The system of claim 1, wherein the indication of temperature comprises alphanumeric text.

3. The system of claim 1, wherein the indication of temperature is displayed in response to at least one of a previously stored user setting or a user input received at a user input device.

4. The system of claim 3, wherein the first zone element is selectable and the user-specified temperature for the first group of shower outlets is adjusted via user input received subsequent to the selection.

5. The system of claim 4, wherein the controller is configured to receive an indication of a user-specified temperature adjustment for the group of shower outlets and to act upon the received indication by changing a temperature of water flowing from the one or more shower outlets of the first group.

6. The system of claim 5, wherein acting upon the received indication comprises the controller providing a control signal to at least one of a valve or a valve controller associated with the first group of shower outlets.

7. The system of claim 1, further comprising a second group of one or more shower outlets, the second group of shower outlets having no shower outlets in common with the first group;

wherein at least one of the graphical user interface elements is a second shower outlet element that is associated with the second group of shower outlets, another of the graphical user interface elements is a second zone element that displays an indication of water temperature for the second group of shower outlets, and the second shower outlet element and the second zone element have a second common color that is different from the first common color for a user to distinguish between the water temperature for the first group of shower outlets and the water temperature for the second group of water outlets.

8. The system of claim 7, wherein the second zone element is selectable and the user-specified temperature for the second group of shower outlets is adjusted via user input received subsequent to the selection.

9. A method for controlling shower output devices, comprising:

causing display of a graphical user interface on an electronic display with a controller, the graphical user interface comprising a plurality of graphical user interface elements, at least one of the graphical user interface elements being a graphical representation of shower layout comprising a first shower outlet element that is associated with a first group of one or more shower outlets and another of the graphical user interface elements being a first zone element, wherein the electronic display is configured to display multiple different graphical user interfaces for controlling the shower outlets, each of the graphical user interfaces comprising a different set of graphical user interface elements; and causing the first zone element to display an indication of temperature of the first group of one or more shower outlets;

wherein the first shower outlet element and the first zone element have a first common color indicating that the water temperature displayed by the first zone element applies to the first group of shower outlets.

10. The system of claim 1, wherein the first group of one or more shower outlets includes at least two shower outlets, the graphical user interface elements include the first shower outlet element and a third shower outlet element that are both associated with the first group of shower outlets, and the first shower outlet element, the third shower outlet element, and the first zone element have the first common color.

11. The method of claim 9, wherein the first group of one or more shower outlets includes at least two shower outlets, the graphical user interface elements include the first shower outlet element and a third shower outlet element that are both associated with the first group of shower outlets, and the first outlet element, the third shower outlet element, and the zone element each have the first common color.

12. The method of claim 9, wherein the indication of temperature comprises alphanumeric text.

13. The method of claim 9, wherein the indication of temperature comprises graphics.

14. The method of claim 9, further comprising:

receiving a selection the first zone element;

receiving a temperature adjustment request for the selected first zone element; and causing the temperature of the first group of shower outlets to be adjusted in response to the received temperature adjustment request.

15. The method of claim 14, further comprising causing change of a visual characteristic of the selected graphical user interface element.

16. The method of claim 14 further comprising causing the indication of temperature to change in response to the received temperature adjustment request.

17. The method of claim 14, wherein at least one of the graphical user interface elements is a second shower outlet element that is associated with a second group of one or more shower outlets, and another of the graphical user interface elements is a second zone element, and the second shower outlet element and the second zone element include a second common color that is different from the first common color for a user to distinguish between the water temperature for the first group of shower outlets and the water temperature for the second group of water outlets;

wherein the method further comprises causing the temperature of the second group of shower outlets to be adjusted independent of the first group of shower outlets.

18. The method of claim 17, further comprising:

receiving a selection of the second zone element;

receiving a temperature adjustment request for the selected second zone element; and causing the temperature of the second group of shower outlets to be adjusted in response to the received temperature adjustment request.

* * * * *